US009541241B2

(12) United States Patent
Pickard et al.

(10) Patent No.: US 9,541,241 B2
(45) Date of Patent: Jan. 10, 2017

(54) LED LAMP

(71) Applicant: Cree, Inc., Durham, NC (US)

(72) Inventors: Paul Kenneth Pickard, Morrisville, NC (US); Elizabeth Rodgers, Raleigh, NC (US)

(73) Assignee: Cree, Inc., Durham, NC (US)

( * ) Notice: Subject to any disclaimer, the term of this patent is extended or adjusted under 35 U.S.C. 154(b) by 44 days.

(21) Appl. No.: 14/044,936

(22) Filed: Oct. 3, 2013

(65) Prior Publication Data

US 2015/0098206 A1 Apr. 9, 2015

(51) Int. Cl.
*F21K 9/00* (2016.01)
*F21K 99/00* (2016.01)

(52) U.S. Cl.
CPC . *F21K 9/56* (2013.01); *F21K 9/23* (2016.08); *F21K 9/60* (2016.08); *F21K 9/64* (2016.08)

(58) Field of Classification Search
CPC ..... F21V 3/0427; F21V 3/049; F21K 9/13; F21K 9/50; F21K 9/56
USPC ..... 362/255, 256, 84
See application file for complete search history.

(56) References Cited

U.S. PATENT DOCUMENTS 3,581,162 A 5/1971 Wheatley
5,442,252 A * 8/1995 Golz ..... F21V 5/048 313/111
5,463,280 A 10/1995 Johnson
5,561,346 A 10/1996 Byrne
5,585,783 A 12/1996 Hall
5,655,830 A 8/1997 Ruskouski
5,688,042 A 11/1997 Madadi et al.
5,806,965 A 9/1998 Deese
5,947,588 A 9/1999 Huang
5,949,347 A 9/1999 Wu
6,220,722 B1 4/2001 Begemann
6,227,679 B1 5/2001 Zhang et al.
6,234,648 B1 5/2001 Borner et al.
(Continued)

FOREIGN PATENT DOCUMENTS

EP 1058221 A2 12/2000
EP 0890059 B1 6/2004
(Continued)

OTHER PUBLICATIONS

Energy Star, Program Requirements for Integral LED Lamps, Mar. 22, 2010, pp. 1-30.

*Primary Examiner* — Renee Chavez
*Assistant Examiner* — Christopher E Dunay
(74) *Attorney, Agent, or Firm* — Dennis J. Williamson; Moore & Van Allen PLLC

(57) ABSTRACT

A lamp comprises an optically transmissive enclosure and a base. An LED assembly is located in the enclosure and is operable to emit light when energized through an electrical path from the base. The LED assembly comprises an LED and a lumophoric dome that surrounds the LED. A partially reflective pad is on the lumophoric dome for manipulating the pattern of light emitted from the lumophoric dome. A heat sink comprises a heat dissipating portion that is at least partially exposed to the ambient environment and a heat conducting portion that is thermally coupled to the LED. An optically transmissive lens emits light from the enclosure where the lens comprises an annular area defined by a textured surface and a transparent area interior of the annular area.

26 Claims, 17 Drawing Sheets

(56) References Cited

U.S. PATENT DOCUMENTS 6,250,774 B1 6/2001 Begemann et al.
6,276,822 B1 8/2001 Bedrosian et al.
6,294,800 B1 * 9/2001 Duggal ..... C09K 11/7734 257/100
6,429,583 B1 * 8/2002 Levinson ..... C09K 11/7734 252/301.4 R
6,465,961 B1 10/2002 Cao
6,523,978 B1 2/2003 Huang
6,550,953 B1 4/2003 Ichikawa et al.
6,634,770 B2 10/2003 Cao
6,659,632 B2 12/2003 Chen
6,709,132 B2 3/2004 Ishibashi
6,803,607 B1 10/2004 Chan et al.
6,848,819 B1 2/2005 Arndt et al.
6,864,513 B2 3/2005 Lin et al.
6,948,829 B2 9/2005 Verdes et al.
6,982,518 B2 1/2006 Chou et al.
7,048,412 B2 5/2006 Martin et al.
7,080,924 B2 7/2006 Tseng et al.
7,086,756 B2 8/2006 Maxik
7,086,767 B2 8/2006 Sidwell et al.
7,144,135 B2 12/2006 Martin et al.
7,165,866 B2 1/2007 Li
7,172,314 B2 2/2007 Currie et al.
7,354,174 B1 4/2008 Yan
7,396,142 B2 7/2008 Laizure, Jr. et al.
7,600,882 B1 10/2009 Morejon et al.
7,726,836 B2 6/2010 Chen
7,824,065 B2 11/2010 Maxik
7,965,023 B1 6/2011 Liang
8,021,025 B2 9/2011 Lee
8,253,316 B2 8/2012 Sun et al.
8,272,762 B2 9/2012 Maxik et al.
8,274,241 B2 9/2012 Guest et al.
8,277,082 B2 10/2012 Dassanayake et al.
8,282,249 B2 10/2012 Liang et al.
8,282,250 B1 10/2012 Dassanayake et al.
8,292,468 B2 10/2012 Narendran et al.
8,322,896 B2 12/2012 Falicoff et al.
8,371,722 B2 2/2013 Carroll
8,400,051 B2 3/2013 Hakata et al.
8,415,865 B2 4/2013 Liang et al.
8,421,320 B2 4/2013 Chuang
8,421,321 B2 4/2013 Chuang
8,421,322 B2 4/2013 Carroll et al.
8,427,037 B2 4/2013 Liang et al.
8,449,154 B2 5/2013 Uemoto et al.
8,502,468 B2 8/2013 Li et al.
8,556,465 B2 10/2013 Lee et al.
8,641,237 B2 2/2014 Chuang
8,653,723 B2 2/2014 Cao et al.
8,696,168 B2 4/2014 Li et al.
8,740,415 B2 6/2014 Wheelock
8,750,671 B1 6/2014 Kelly et al.
8,752,984 B2 6/2014 Lenk et al.
8,760,042 B2 6/2014 Sakai et al.
8,796,915 B2 * 8/2014 Ooya et al. ..... 313/503
8,870,409 B2 * 10/2014 Ye et al. ..... 362/223
2004/0201990 A1 10/2004 Meyer
2009/0184618 A1 7/2009 Hakata et al.
2011/0215696 A1 * 9/2011 Tong et al. ..... 313/46
2011/0273102 A1 11/2011 Van De Ven et al.
2011/0299284 A1 * 12/2011 Van De Ven ..... F21K 9/137 362/293
2012/0040585 A1 2/2012 Huang
2012/0170267 A1 * 7/2012 Shang et al. ..... 362/235
2012/0250305 A1 * 10/2012 Shimizu ..... F21K 9/1355 362/231
2013/0026923 A1 1/2013 Athalye et al.
2013/0026925 A1 1/2013 Ven et al.
2013/0069535 A1 3/2013 Athalye
2013/0069547 A1 3/2013 Van De Ven et al.
2013/0077303 A1 * 3/2013 Ariyoshi ..... F21V 7/0033 362/235
2013/0127353 A1 5/2013 Athalye et al.
2013/0162149 A1 6/2013 Van De Ven et al.
2013/0162153 A1 6/2013 Van De Ven et al.
2013/0169159 A1 7/2013 Lys
2013/0293135 A1 11/2013 Hu et al.
2014/0078746 A1 * 3/2014 Caldwell ..... F21K 9/135 362/309
2014/0092580 A1 * 4/2014 McCollum et al. ..... 362/84
2014/0098531 A1 * 4/2014 Grajcar ..... F21K 9/135 362/235
2014/0146518 A1 * 5/2014 Chen ..... 362/84
2014/0233213 A1 * 8/2014 Frischeisen et al. ..... 362/84
2014/0268744 A1 * 9/2014 Nourbakhsh et al. ..... 362/235
2014/0374786 A1 * 12/2014 Bierhuizen ..... 257/98

FOREIGN PATENT DOCUMENTS

GB 2345954 A 7/2000
JP H09265807 A 10/1997
JP 2000173304 A 6/2000
JP 2001118403 A 4/2001
WO 0124583 A1 4/2001
WO 0160119 A2 8/2001
WO 2012011279 A1 1/2012
WO 2012031533 A1 3/2012

* cited by examiner

LED LAMP

BACKGROUND

Light emitting diode (LED) lighting systems are becoming more prevalent as replacements for older lighting systems. LED systems are an example of solid state lighting (SSL) and have advantages over traditional lighting solutions such as incandescent and fluorescent lighting because they use less energy, are more durable, operate longer, can be combined in multi-color arrays that can be controlled to deliver virtually any color light, and generally contain no lead or mercury. A solid-state lighting system may take the form of a lighting unit, light fixture, light bulb, or a "lamp."

An LED lighting system may include, for example, a packaged light emitting device including one or more light emitting diodes (LEDs), which may include inorganic LEDs, which may include semiconductor layers forming p-n junctions and/or organic LEDs (OLEDs), which may include organic light emission layers. Light perceived as white or near-white may be generated by a combination of red, green, and blue ("RGB") LEDs. Output color of such a device may be altered by separately adjusting supply of current to the red, green, and blue LEDs. Another method for generating white or near-white light is by using a lumiphor such as a phosphor. Still another approach for producing white light is to stimulate phosphors or dyes of multiple colors with an LED source. Many other approaches can be taken.

An LED lamp may be made with a form factor that allows it to replace a standard incandescent bulb, or any of various types of fluorescent lamps. LED lamps often include some type of optical element or elements to allow for localized mixing of colors, collimate light, or provide a particular light pattern. Sometimes the optical element also serves as an envelope or enclosure for the electronics and or the LEDs in the lamp.

Since, ideally, an LED lamp designed as a replacement for a traditional incandescent or fluorescent light source needs to be self-contained; a power supply is included in the lamp structure along with the LEDs or LED packages and the optical components. A heatsink is also often needed to cool the LEDs and/or power supply in order to maintain appropriate operating temperature.

SUMMARY OF THE INVENTION

In some embodiments a lamp comprises an enclosure that is at least partially optically transmissive and a base. At least one LED is located in the enclosure and is operable to emit light when energized through an electrical path from the base. A lumophoric dome, remote from the at least one LED, surrounds the at least one LED. A heat sink comprises a heat conducting portion that is thermally coupled to the at least one LED and a heat dissipating portion that is at least partially exposed to the ambient environment. A partially reflective pad is disposed on the lumophoric dome for manipulating the pattern of light emitted from the lumophoric dome.

The base may comprise an Edison connector. The at least one LED may be mounted on the heat sink in a center of the enclosure. The at least one LED may be attached to a submount and the submount may be thermally and mechanically coupled to the heat sink. The at least one LED may emit blue light and the lumiphoric dome may emit a white light. The at least one LED may provide a Lumen output of between 1400 and 1600 Lumens. The lamp may operate at approximately 15 Watts, with approximately 108-110 Lumens per Watt. The at least one LED may be disposed horizontally and may be positioned near the bottom of the lumophoric dome and the pad may be disposed near a top of the lumophoric dome. The pad may comprise a silicone impregnated with TiO2. A reflective surface may be provided for creating a directional light pattern. The reflective surface may be formed on a lamp housing. The reflective surface may be formed on a reflector located in a lamp housing. The lumophoric dome may be conical or it may be dome-shaped. The lumiphoric dome may carry a phosphor. The phosphor may be impregnated in the lumiphoric dome or it may be coated on the lumiphoric dome. A lamp housing may be thermally coupled to the heat sink and may be exposed to the exterior of the lamp such that heat from the heat sink may be dissipated to the ambient environment at least partially through the housing.

In some embodiments a LED assembly comprises at least one LED operable to emit light when energized. A lumophoric dome surrounds the at least one LED. A partially reflective pad is disposed on the lumophoric dome for manipulating the pattern of light emitted from the dome.

The pad may be on the outside or the inside of the dome. The pad may be partially transmissive. The pad may be diffusive. The pad may comprise a precursor component and a diffusing material. The precursor component may comprise silicone. The diffusing material may comprise titanium dioxide. The pad may be molded into the lumophoric dome. The pad may be a coating on the lumophoric dome.

In some embodiments a directional lamp comprises an enclosure and a base. At least one LED is located in the enclosure and is operable to emit light when energized through an electrical path from the base. An optically transmissive lens emits light from the enclosure. The lens comprises an annular area defined by a textured surface and a transparent area interior of the annular area. The annular area may be adjacent a peripheral edge of the lens.

DETAILED DESCRIPTION

Figure 1:
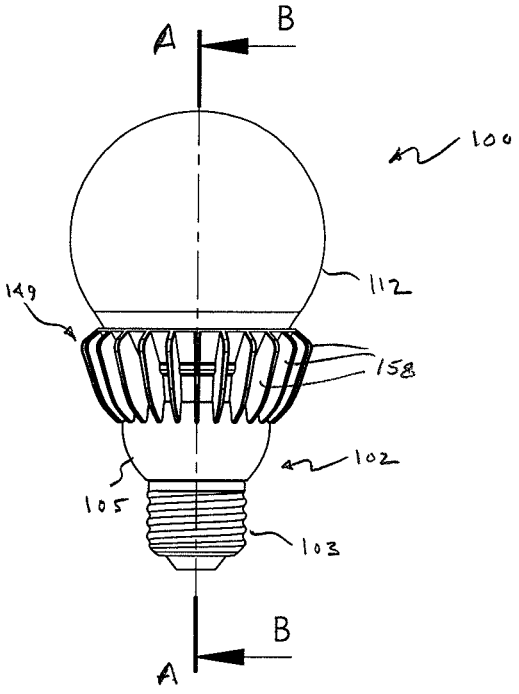
FIG. 1 is a front view of an embodiment of a lamp of the invention.

Embodiments of the present invention now will be described more fully hereinafter with reference to the accompanying drawings, in which embodiments of the invention are shown. This invention may, however, be embodied in many different forms and should not be construed as limited to the embodiments set forth herein. Rather, these embodiments are provided so that this disclosure will be thorough and complete, and will fully convey the scope of the invention to those skilled in the art. Like numbers refer to like elements throughout.

It will be understood that, although the terms first, second, etc. may be used herein to describe various elements, these elements should not be limited by these terms. These terms are only used to distinguish one element from another. For example, a first element could be termed a second element, and, similarly, a second element could be termed a first element, without departing from the scope of the present invention. As used herein, the term "and/or" includes any and all combinations of one or more of the associated listed items.

It will be understood that when an element such as a layer, region or substrate is referred to as being "on" or extending "onto" another element, it can be directly on or extend directly onto the other element or intervening elements may also be present. In contrast, when an element is referred to as being "directly on" or extending "directly onto" another element, there are no intervening elements present. It will also be understood that when an element is referred to as being "connected" or "coupled" to another element, it can be directly connected or coupled to the other element or intervening elements may be present. In contrast, when an element is referred to as being "directly connected" or "directly coupled" to another element, there are no intervening elements present.

Relative terms such as "below" or "above" or "upper" or "lower" or "horizontal" or "vertical" or "top" or "bottom" may be used herein to describe a relationship of one element, layer or region to another element, layer or region as illustrated in the figures. It will be understood that these terms are intended to encompass different orientations of the device in addition to the orientation depicted in the figures.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" "comprising," "includes" and/or "including" when used herein, specify the presence of stated features, integers, steps, operations, elements, and/or components, but do not preclude the presence or addition of one or more other features, integers, steps, operations, elements, components, and/or groups thereof.

Unless otherwise defined, all terms (including technical and scientific terms) used herein have the same meaning as commonly understood by one of ordinary skill in the art to which this invention belongs. It will be further understood that terms used herein should be interpreted as having a meaning that is consistent with their meaning in the context of this specification and the relevant art and will not be interpreted in an idealized or overly formal sense unless expressly so defined herein.

Unless otherwise expressly stated, comparative, quantitative terms such as "less" and "greater", are intended to encompass the concept of equality. As an example, "less" can mean not only "less" in the strictest mathematical sense, but also, "less than or equal to."

Any aspect or features of any of the embodiments described herein can be used with any feature or aspect of any other embodiments described herein or integrated together or implemented separately in single or multiple components.

The terms "LED" and "LED device" as used herein may refer to any solid-state light emitter. The terms "solid state light emitter" or "solid state emitter" may include a light emitting diode, laser diode, organic light emitting diode, and/or other semiconductor device which includes one or more semiconductor layers, which may include silicon, silicon carbide, gallium nitride and/or other semiconductor materials, a substrate which may include sapphire, silicon, silicon carbide and/or other microelectronic substrates, and one or more contact layers which may include metal and/or other conductive materials. A solid-state lighting device produces light (ultraviolet, visible, or infrared) by exciting electrons across the band gap between a conduction band and a valence band of a semiconductor active (light-emitting) layer, with the electron transition generating light at a wavelength that depends on the band gap. Thus, the color (wavelength) of the light emitted by a solid-state emitter depends on the materials of the active layers thereof. In various embodiments, solid-state light emitters may have peak wavelengths in the visible range and/or be used in combination with lumiphoric materials having peak wavelengths in the visible range. Multiple solid state light emitters may be used in a single device, such as to produce light perceived as white or near white in character. In certain embodiments, the aggregated output of multiple solid-state light emitters may generate warm white light output having a color temperature range of from about 2200K to about 6000K.

Solid state light emitters may be used individually or in combination with one or more lumophoric materials (e.g., phosphors, scintillators, lumiphoric inks, luminophores, lumophores, lumiphores) to generate light at a peak wavelength, or of at least one desired perceived color (including combinations of colors that may be perceived as white). Inclusion of lumophoric (also called 'luminescent') materials in lighting devices as described herein may be accomplished by coating on, or embedding or dispersing such lumophoric materials within a lumophoric support medium. Other materials, such as light scattering elements (e.g., particles) and/or index matching materials, may be associated with the lumophoric material or the lumophoric material support medium.

Embodiments of the present invention provide a solid-state lamp with centralized light emitters, more specifically, LEDs. Multiple LEDs can be used together, forming an LED array. The LEDs can be mounted on or fixed within the lamp in various ways. In at least some example embodiments, a submount is used. The LEDs are disposed at or near the central portion of the structural envelope of the lamp. Since the LED array may be configured in some embodiments to reside centrally within the structural envelope of the lamp, a lamp can be constructed so that the light pattern is not adversely affected by the presence of a heat sink and/or mounting hardware, or by having to locate the LEDs close to the base of the lamp.

Figure 2:
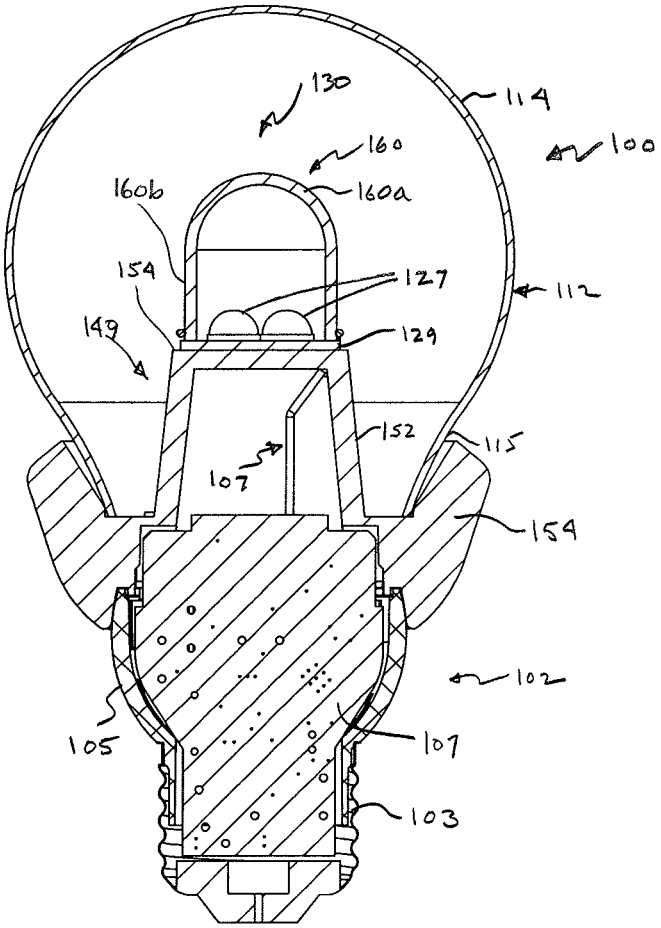
FIG. 2 is a section view taken along line B-B of FIG. 1.
Figure 8:
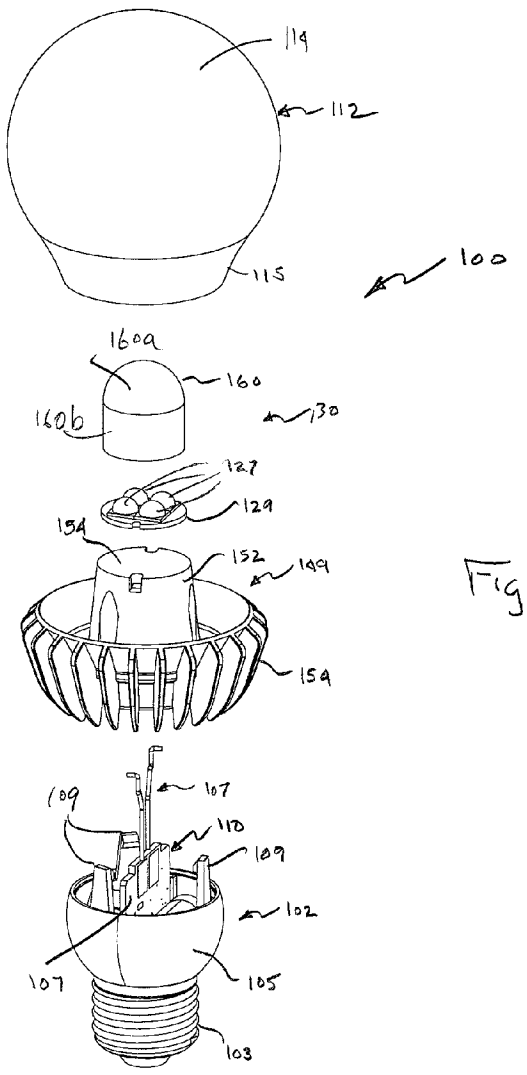
FIG. 8 is an exploded perspective view of the lamp of FIG. 1.

FIGS. 1, 2 and 8 show a lamp, 100, according to some embodiments of the present invention. Lamp 100 may be used as an A-series lamp with an Edison base 102, more particularly; lamp 100 may be designed to serve as a solid-state replacement for an A21 incandescent bulb or similar bulb. The Edison base 102 as shown and described herein may be implemented through the use of an Edison connector 103 and a plastic form 105. An optically transmissive enclosure 112 is mounted to the base 102. A plurality of LEDs 127 are supported in the enclosure 112 an are operable to emit light when energized through an electrical path from the base. The LEDs 127 may comprise an LED die disposed in an encapsulant such as silicone. The LEDs 127 may be mounted on a submount 129 and are operable to emit light when energized through an electrical connection. In the present invention the term "submount" is used to refer to the support structure that supports the individual LEDs or LED packages and in one embodiment comprises a printed circuit board or "PCB" such as a metal core printed circuit board "MCPCB" although it may comprise other structures such as a lead frame extrusion or the like or combinations of such structures. In some embodiments, a driver or power supply may be included with the LED array on the submount. In some cases the driver may be formed by components on the PCB. Multiple LEDs 127 can be used together, forming an LED array. The LEDs 127 can be mounted on or fixed within the lamp in various ways. The LEDs 127 in the LED array include LEDs which may comprise an LED die disposed in an encapsulant such as silicone. A wide variety of LEDs and combinations of LEDs may be used in the LED assembly 130 as described herein. While a lamp having the size and form factor of a standard-sized household incandescent bulb is shown, the lamp may have other the sizes and form factors. For example, the lamp may be a PAR-style lamp such as a replacement for a PAR-38 incandescent bulb or a BR-style incandescent bulb.

Enclosure 112 is, in some embodiments, made of glass, quartz, borosilicate, silicate, polycarbonate, other plastic or other suitable material. The enclosure may be of similar shape to that commonly used in household incandescent bulbs. In some embodiments, the enclosure is coated on the inside with silica, providing a diffuse scattering layer that produces a more uniform far field pattern. The enclosure may also be etched, frosted or coated. Alternatively, the surface treatment may be omitted and a clear enclosure may be provided. The enclosure may also be provided with a shatter proof or shatter resistant coating. The glass enclosure 112 may have a traditional bulb shape having a globe shaped main body 114 that tapers to a narrower neck 115.

A lamp base 102 such as an Edison connector 103 functions as the electrical connector to connect the lamp 100 to an electrical socket or other connector. Depending on the embodiment, other base configurations are possible to make the electrical connection such as other standard bases or non-traditional bases. Base 102 may include the electronics 110 for powering lamp 100 and may include a power supply and/or driver and form all or a portion of the electrical path between the mains and the LEDs. Base 102 may also include only part of the power supply circuitry while some smaller components reside on the submount. The LEDs 127 are operable to emit light when energized through an electrical connection. An electrical path runs between the submount 129 and the lamp base 102 to carry both sides of the supply to provide critical current to the LEDs 127. With the embodiment of FIG. 1, as with many other embodiments of the invention, the term "electrical path" can be used to refer to the entire electrical path to the LEDs, including an intervening power supply disposed between the electrical connection that would otherwise provide power directly to the LEDs, or it may be used to refer to the connection between the mains and all the electronics in the lamp, including the power supply. The term may also be used to refer to the connection between the power supply and the LED array. Electrical conductors, such as wires, 107 run between the LED assembly 130 and the lamp electronics 110 in base 102 to carry both sides of the supply to provide critical current to the LEDs 127.

The base 102 comprises an electrically conductive Edison screw 103 for connecting to an Edison socket and a housing portion 105 connected to the Edison screw. The Edison screw 103 may be connected to the housing portion 105 by adhesive, mechanical connector, welding, separate fasteners or the like. The housing portion 105 may comprise an electrically insulating material such as plastic. Further, the material of the housing portion 105 may comprise a thermally conductive material such that the housing portion 105 may form part of the heat sink structure for dissipating heat from the lamp 100. The housing portion 105 and the Edison screw 103 define an internal cavity for receiving the electronics 110 of the lamp. The lamp electronics may comprise printed a circuit board 107 which includes the power supply, including large capacitor and EMI components that are across the input AC line along with the driver circuitry as described herein. The lamp electronics 110 are electrically coupled to the Edison screw 103 such that the electrical connection may be made from the Edison screw 103 to the lamp electronics 110. The base 102 may be potted to physically and electrically isolate and protect the lamp electronics 110.

In some embodiments, a driver and/or power supply are included with the LEDs on the submount 129. In other embodiments the driver and/or power supply are included in the base 102 as shown. The power supply and drivers may also be mounted separately where components of the power supply are mounted in the base 102 and the driver is mounted with the submount 129 in the enclosure 112. Base 102 may include a power supply or driver and form all or a portion of the electrical path between the mains and the LEDs 127. The base 102 may also include only part of the power supply circuitry while some smaller components reside on the submount 129. In some embodiments any component that goes directly across the AC input line may be in the base 102 and other components that assist in converting the AC to useful DC may be in the glass enclosure 112. In one example embodiment, the inductors and capacitor that form part of the EMI filter are in the Edison base. Suitable power supplies and drivers are described in U.S. patent application Ser. No. 13/462,388 filed on May 2, 2012 and titled "Driver Circuits for Dimmable Solid State Lighting Apparatus" which is incorporated herein by reference in its entirety; U.S. patent application Ser. No. 12/775,842 filed on May 7, 2010 and titled "AC Driven Solid State Lighting Apparatus with LED String Including Switched Segments" which is incorporated herein by reference in its entirety; U.S. patent application Ser. No. 13/192,755 filed Jul. 28, 2011 titled "Solid State Lighting Apparatus and Methods of Using Integrated Driver Circuitry" which is incorporated herein by reference in its entirety; U.S. patent application Ser. No. 13/339,974 filed Dec. 29, 2011 titled "Solid-State Lighting Apparatus and Methods Using Parallel-Connected Segment Bypass Circuits" which is incorporated herein by reference in its entirety; U.S. patent application Ser. No. 13/235,103 filed Sep. 16, 2011 titled "Solid-State Lighting Apparatus and Methods Using Energy Storage" which is incorporated herein by reference in its entirety; U.S. patent application Ser. No. 13/360,145 filed Jan. 27, 2012 titled "Solid State Lighting Apparatus and Methods of Forming" which is incorporated herein by reference in its entirety; U.S. patent application Ser. No. 13/338,095 filed Dec. 27, 2011 titled "Solid-State Lighting Apparatus Including an Energy Storage Module for Applying Power to a Light Source Element During Low Power Intervals and Methods of Operating the Same" which is incorporated herein by reference in its entirety; U.S. patent application Ser. No. 13/338,076 filed Dec. 27, 2011 titled "Solid-State Lighting Apparatus Including Current Diversion Controlled by Lighting Device Bias States and Current Limiting Using a Passive Electrical Component" which is incorporated herein by reference in its entirety; and U.S. patent application Ser. No. 13/405,891 filed Feb. 27, 2012 titled "Solid-State Lighting Apparatus and Methods Using Energy Storage" which is incorporated herein by reference in its entirety.

The AC to DC conversion may be provided by a boost topology to minimize losses and therefore maximize conversion efficiency. The boost supply may be connected to high voltage LEDs operating at greater than 200V. Other embodiments are possible using different driver configurations, or a boost supply at lower voltages. Examples of boost topologies are described in U.S. patent application Ser. No. 13/462,388, entitled "Driver Circuits for Dimmable Solid State Lighting Apparatus", filed on May 2, 2012 which is incorporated by reference herein in its entirety; and U.S. patent application Ser. No. 13/662,618, entitled "Driving Circuits for Solid-State Lighting Apparatus with High Voltage LED Components and Related Methods", filed on Oct. 29, 2012 which is incorporated by reference herein in its entirety. With boost technology there is a relatively small power loss when converting from AC to DC. For example, boost technology may be approximately 92% efficient while other power converting technology, such as Bud technology, may be approximately 85% efficient. Using a less efficient conversion technology decreases the efficiency of the system such that significant losses occur in the form of heat. The increase in heat must be dissipated from the lamp because heat adversely affects the performance characteristics of the LEDs. The increase in efficiency using boost technology maximizes power to the LEDs while minimizing heat generated as loss. As a result, use of boost topology, or other highly efficient topology, provides an increase in the overall efficiency of the lamp and a decrease in the heat generated by the power supply.

The LED assembly 130 comprises a submount 129 arranged such that the LEDs are positioned at the approximate center of enclosure 112. As used herein the terms "center of the enclosure" and/or "optical center of the enclosure" refers to the vertical position of the LEDs in the enclosure as being aligned with the approximate largest diameter area of the globe shaped main body 114. "Vertical" as used herein means along the longitudinal axis of the bulb where the longitudinal axis extends from the base to the free end of the bulb as represented for example by line A-A in FIG. 1. The terms "center of the enclosure" and "optical center of the enclosure" do not necessarily mean the exact center of the enclosure and are used to signify that the LEDs are located along the longitudinal axis of the lamp at a position between the ends of the enclosure near a central portion of the enclosure. In one embodiment, the LEDs are arranged in the approximate location that the visible glowing filament is disposed in a standard incandescent bulb. In the lamp of the invention, the LEDs 127 are arranged at or near the optical center of the enclosure 112 in order to efficiently transmit the lumen output of the LED assembly through the enclosure 112. Locating the LEDs at the optical center of the lamp also creates a bright spot of light near the optical center of the bulb in the same location as the glowing filament in a traditional incandescent bulb such that the lamp of the invention mimics the glow of a traditional incandescent bulb. In the various embodiments described herein, the LED assembly is in the form of an LED tower 152 within the enclosure, the LEDs 127 are mounted on the LED tower 152 in a manner that mimics the appearance of a traditional incandescent bulb. As a result, the lamps of the invention provide similar optical light patterns to a traditional incandescent bulb and provide a similar physical appearance during use. The LEDs are centrally located in the enclosure on the tower in the free open space of the enclosure as distinguished from being mounted at or on the bottom of the enclosure or on the enclosure walls.

In one embodiment, the enclosure and base are dimensioned to be a replacement for an ANSI standard A21 bulb such that the dimensions of the lamp 100 fall within the ANSI standards for an A21 bulb. The dimensions may be different for other ANSI standards including, but not limited to, A19 and A23 standards. While specific reference has been made with respect to an A-series lamp with an Edison base 102 the structure and assembly method may be used on other lamps such as a PAR-style lamp such as a replacement for a PAR-38 incandescent bulb or a BR-style lamp. In other embodiments, the LED lamp can have any shape, including standard and non-standard shapes.

The submount may comprise a series of anodes and cathodes arranged in pairs for connection to the LEDs 127. In the illustrated embodiment 4 pairs of anodes and cathodes are shown for an LED assembly having 4 LEDs or 4 LED arrays 127; however, a greater or fewer number of anode/cathode pairs and LEDs/LED arrays may be used. Moreover, more than one submount may be used to make a single LED assembly 130. Connectors or conductors such as traces connect the anode from one pair to the cathode of the adjacent pair to provide the electrical path between the anode/cathode pairs during operation of the LED assembly 130. An LED or LED package containing at least one LED 127 is secured to each anode and cathode pair where the LED/LED package spans the anode and cathode. The LEDs/LED packages may be attached to the submount by soldering. The submount 129 is thermally and mechanically coupled to the heat sink 149 such that heat may be dissipated from the LED assembly via the heat sink. The submount 129 may be made of a thermally conductive material. The entire area of the submount 129 may be thermally conductive such that the LED assembly 130 transfers heat to the heat sink 149. The submount 129 may be attached to the heat sink using thermal adhesive, a mechanical connector, brazing or other mechanism.

LEDs 127 used with an embodiment of the invention and can include light emitting diode chips that emit blue hues of light that, when used with a phosphor, emit light that is perceived white light. Blue or violet LEDs 127 can be used in the LED assembly 130 of the lamp and the appropriate lumophoric material, such as a phosphor, may be supported in a remote dome 160 that surrounds the blue LEDs to create substantially white light. Such embodiments can produce light with a CRI of at least 70, at least 80, at least 90, or at least 95. Such a lighting system is typically referred to as a blue shifted yellow or BSY system. In one embodiment, four CREE CXA LED arrays may be used where the arrays are not provided with localized phosphors such that the arrays emit blue light. In other embodiments individual LEDs or other combinations of LEDs may be mounted on the substrate. In some embodiments the LEDs may provide a Lumen output of between 1400 and 1600 Lumens, where the output may be approximately 1400 Lumens, approximately 1500 Lumens or approximately 1600 Lumens. The lamp may operate at approximately 15 Watts with approximately 108-110 Lumens per Watt. In such embodiments the lamp is approximately equivalent to a standard 100 watt A-series lamp.

A lumophoric material such as a yellow phosphor is used with the dome 160 to convert the blue hue of light emitted by the LEDs 127 to a visible white light. The lumophoric material is provided remotely from the LEDs on dome 160 that is impregnated, coated or otherwise provided with a suitable lumophoric material. One such yellow phosphor is cerium doped yttrium aluminum garnet although any suitable phosphor or other lumophoric material may be used. An air gap is created between the LEDs 127 and the dome 160. The dome 160 may comprise a moldable material such as silicone impregnated with a suitable phosphor that is molded into the desired dome shape. In other embodiments the dome may be made of glass, silicone or other suitable material that is coated in a phosphor or other lumophoric material. The dome 160 provided with phosphor or other lumophoric material is referred to herein as a lumophoric dome. The lumophoric dome 160 may have a semispherical or parabolic top portion 160*a* that is connected to a cylindrical base portion 160*b* to generate an omnidirectional light pattern that is suitable for use in a lamp that may be used as a replacement for a traditional A21, A19, or A23 bulb. The base portion 160*b* and the top portion 160*a* may be formed as a single piece. The lumophoric dome 160*a* may be attached to the submount 129 or to the heat sink 149 by any suitable connection provided that the connection mechanism does not interfere with light emitted from the dome 160. For example, the lumophoric dome 160 may be attached using an adhesive or a mechanical engagement. The LEDs 127 are positioned near the bottom of the lumophoric dome 160 such that light emitted from the dome is emitted in a substantially omnidirectional pattern. The luimophoric dome is positioned such that the interior surface of the dome is spaced from the LEDs and the dome surrounds the LEDs. It will be appreciated that surrounds as used herein means that the dome covers or substantially covers the light emitting area of the LEDs such that the light emitted from the LEDs passes through the dome. As shown in the drawings because the LEDs are mounted on a submount and tower, the dome does not extend to below the LEDs; however, the dome is arranged such that light from the LEDs passes through the dome into the enclosure.

The heat sink structure 149 comprises a heat conducting portion or tower 152 and a heat dissipating portion 154 as shown for example in FIG. 2. In one embodiment the heat sink 149 is made as a one-piece member of a thermally conductive material such as aluminum. The heat sink structure 149 may also be made of multiple components secured together to form the heat structure. Moreover, the heat sink 149 may be made of any thermally conductive material or combinations of thermally conductive materials. The heat conducting portion 152 is formed as a tower that is dimensioned and configured to make good thermal contact with the LED assembly 130 such that heat generated by the LED assembly 130 may be efficiently transferred to the heat sink 149. In one embodiment, the heat conducting portion 152 comprises a tower that extends along the longitudinal axis of the lamp and extends into the center of the enclosure. The heat conducting portion 152 may comprise generally planar support surface 154 that supports the generally planar submount 129 of the LED assembly 130. While the heat conducting portion 152 is shown as being generally cylindrical the heat conducting portion may have any configuration. While heat transfer may be most efficiently made by forming the heat conducting portion 152 and the LED assembly 130 with mating planar shapes, the shapes of these components may be different provided that sufficient heat is conducted away from the LED assembly 130 that the operation and/or life expectancy of the LEDs are not adversely affected.

The heat dissipating portion 154 is in good thermal contact with the heat conducting portion 152 such that heat conducted away from the LED assembly 130 by the heat conducting portion 152 may be efficiently dissipated from the lamp 100 by the heat dissipating portion 154. In one embodiment the heat conducting portion 152 and heat dissipating portion 154 are formed as one-piece. The heat dissipating portion 154 extends from the interior of the enclosure 112 to the exterior of the lamp 100 such that heat may be dissipated from the lamp to the ambient environment. In one embodiment the heat dissipating portion 154 is formed generally as a disk where the distal edge of the heat dissipating portion 154 extends outside of the lamp and forms an annular ring that sits on top of the open end of the base 102. A plurality of heat dissipating members 158 may be formed on the exposed portion to facilitate the heat transfer to the ambient environment. In one embodiment, the heat dissipating members 158 comprise a plurality fins that extend outwardly to increase the surface area of the heat dissipating portion 154. The heat dissipating portion 154 and fins 158 may have any suitable shape and configuration.

Different embodiments of the LED assembly and heat sink tower are possible. In various embodiments, the LED assembly and heat sink may be relatively shorter, longer, wider or thinner than that shown in the illustrated embodiment. Moreover the LED assembly may engage the heat sink and electronics in a variety of manners. For example, the heat sink may only comprise the heat dissipating portion 154 and the heat conducting portion or tower 152 may be integrated with the LED assembly 130 such that the integrated heat sink portion and LED assembly engage the heat dissipating portion 154 at its base. In some embodiments, the LED assembly and heat sink may be integrated into a single piece or be multiple pieces other than as specifically defined.

The light pattern emitted from the lumophoric dome 160 may be manipulated to achieve a desired light pattern. While the desired light intensity distribution may comprise any light intensity distribution, in one embodiment the desired light intensity distribution conforms to the ENERGY STAR® Partnership Agreement Requirements for Luminous Intensity Distribution, which is incorporated herein by reference. For an omnidirectional lamp the Luminous Intensity Distribution is defined as "an even distribution of luminous intensity (candelas) within the 0° to 135° zone (vertically axially symmetrical). Luminous intensity at any angle within this zone shall not differ from the mean luminous intensity for the entire 0° to 135° zone by more than 20%. At least 5% of total flux (lumens) must be emitted in the 135°-180° zone. Distribution shall be vertically symmetrical as measures in three vertical planes at 0°, 45°, and 90°." The free end of the enclosure 112, opposite to the base, is considered 0° and the base of the lamp is considered 180°. As defined in the standard, luminous intensity is measured from 0° to 135° where the measurements are repeated in vertical planes at 0°, 45° and 90°.

The structure and operation of lamp 100 of the invention is described with specific reference to the ENERGY STAR® standard set forth above; however, the lamp as described herein may be used to create other light intensity distribution patterns. One challenge in providing an LED based lamp that meets the ENERGY STAR® standard is providing sufficient downlight. "Downlight" as used herein means light directed toward the base 102 of the lamp. Because LEDs tend to emit significantly more light toward the top of the LED than as backlight and because solid state lamps tend to use relatively large bases to house the lamp electronics and provide a sufficient heat sink, the base may block some emitted light such that the downlight may be less than as set forth in the ENERGY STAR® standard.

Figure 3:
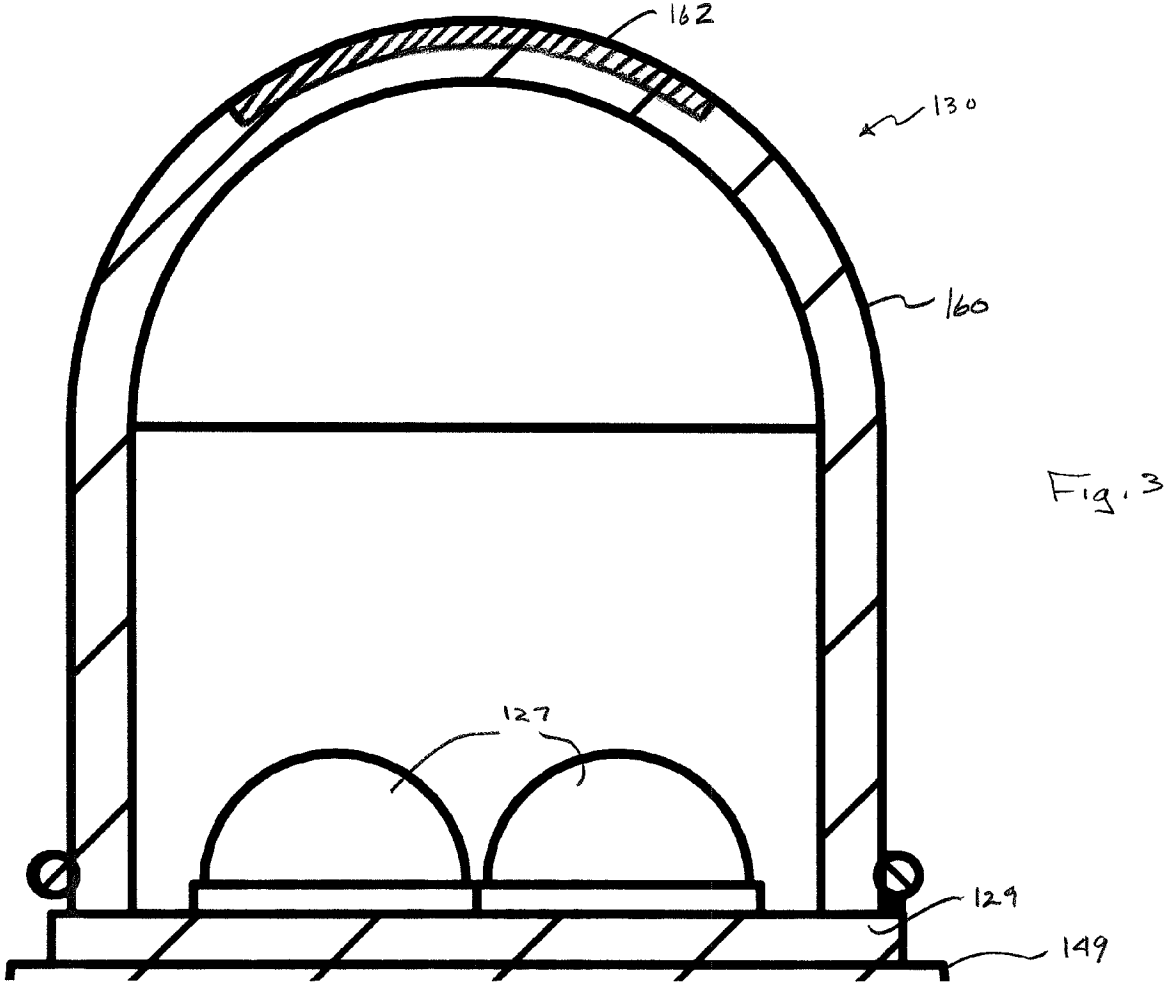
FIGS. 3-7 are detailed side views of embodiments of the LED assembly of the lamp of FIG. 1.

To manipulate the light pattern emitted by the lumophoric dome 160 a reflective, a partially reflective and partially transmissive, or translucent pad 162 may be applied to the lumophoric dome 160 to redirect a portion of the light emitted by the LEDs 127 to create a desired light pattern as shown in FIG. 3. The LEDs 127 may be arranged as shown in the drawings with the base of the LEDs 127 mounted horizontally on the top of the heat sink 149. In such an arrangement most of the light emitted by the LEDs 127 will be directed toward the top of the lumophoric dome 160. As used herein the bottom of the lamp refers the base 102, the top of the lamp means the distal free end of the enclosure 112 remote from the base 102 and "horizontal" means perpendicular to the longitudinal axis A-A of the lamp. Because in such an arrangement most of the light is emitted toward the top of the lumophoric dome 160 and therefore toward the top of the lamp it may be necessary in some applications to redirect a portion of the light laterally towards the sides of the lumophoric dome and toward the sides and bottom of the lamp.

Figure 4:
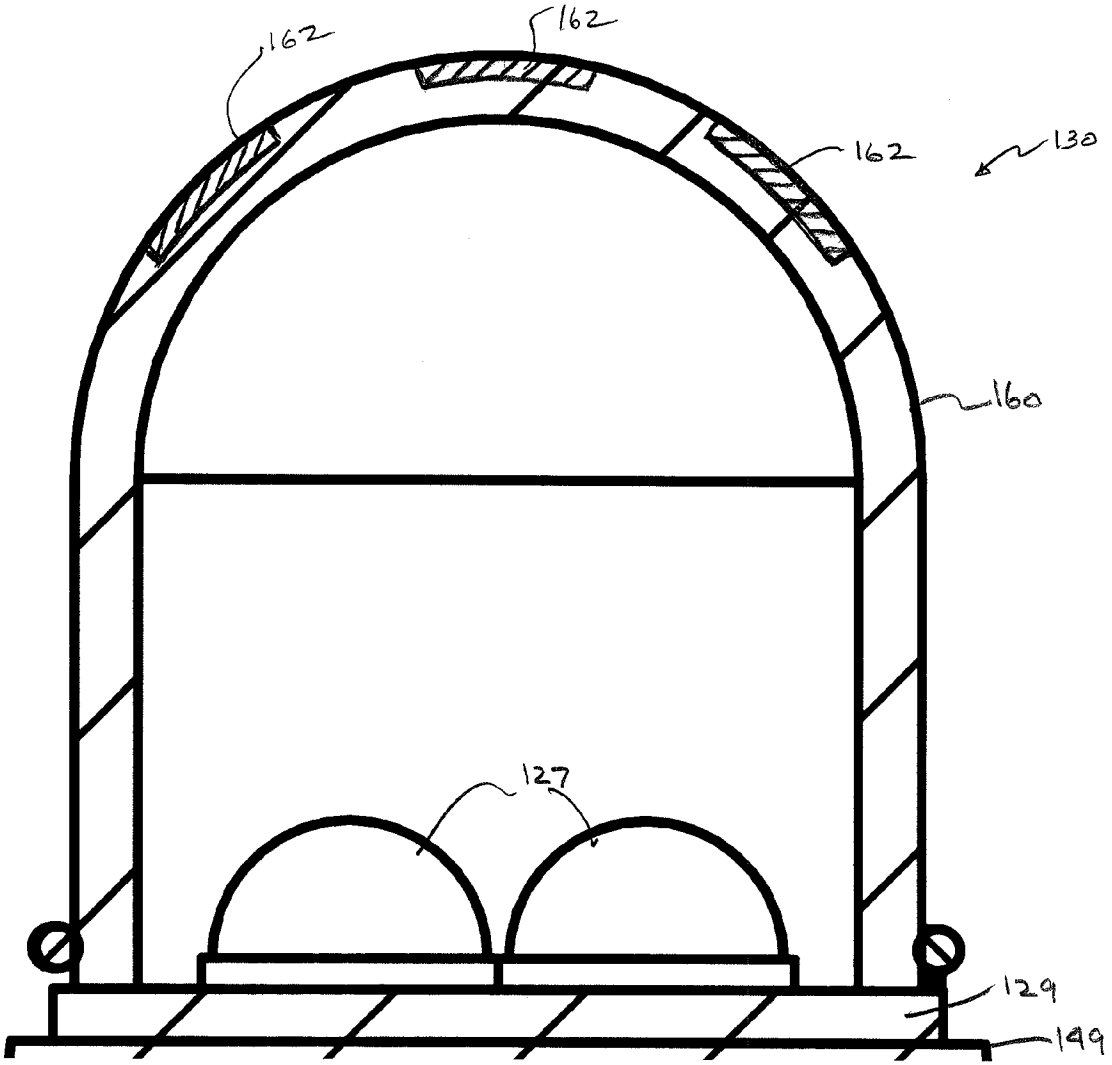
Figure 5:
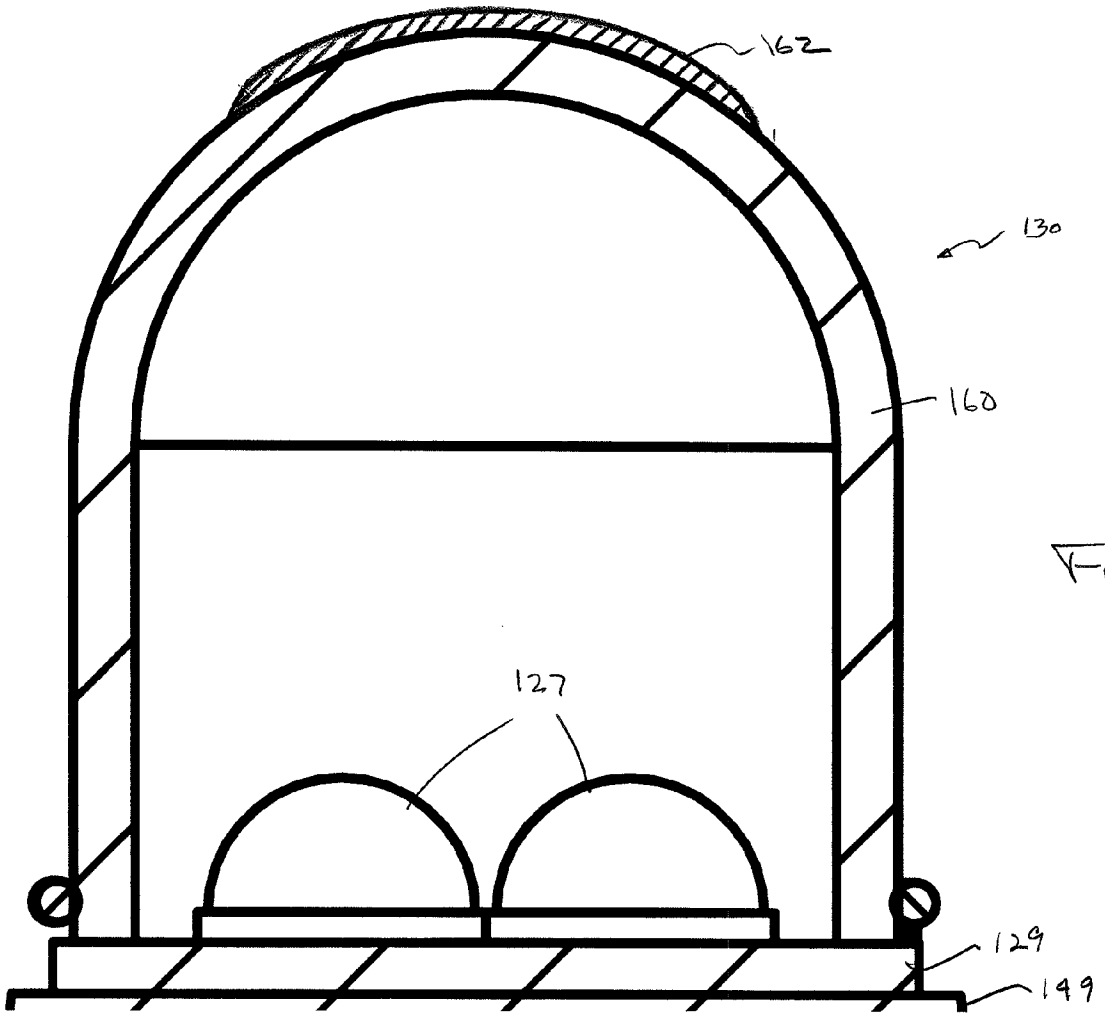
Figure 6:
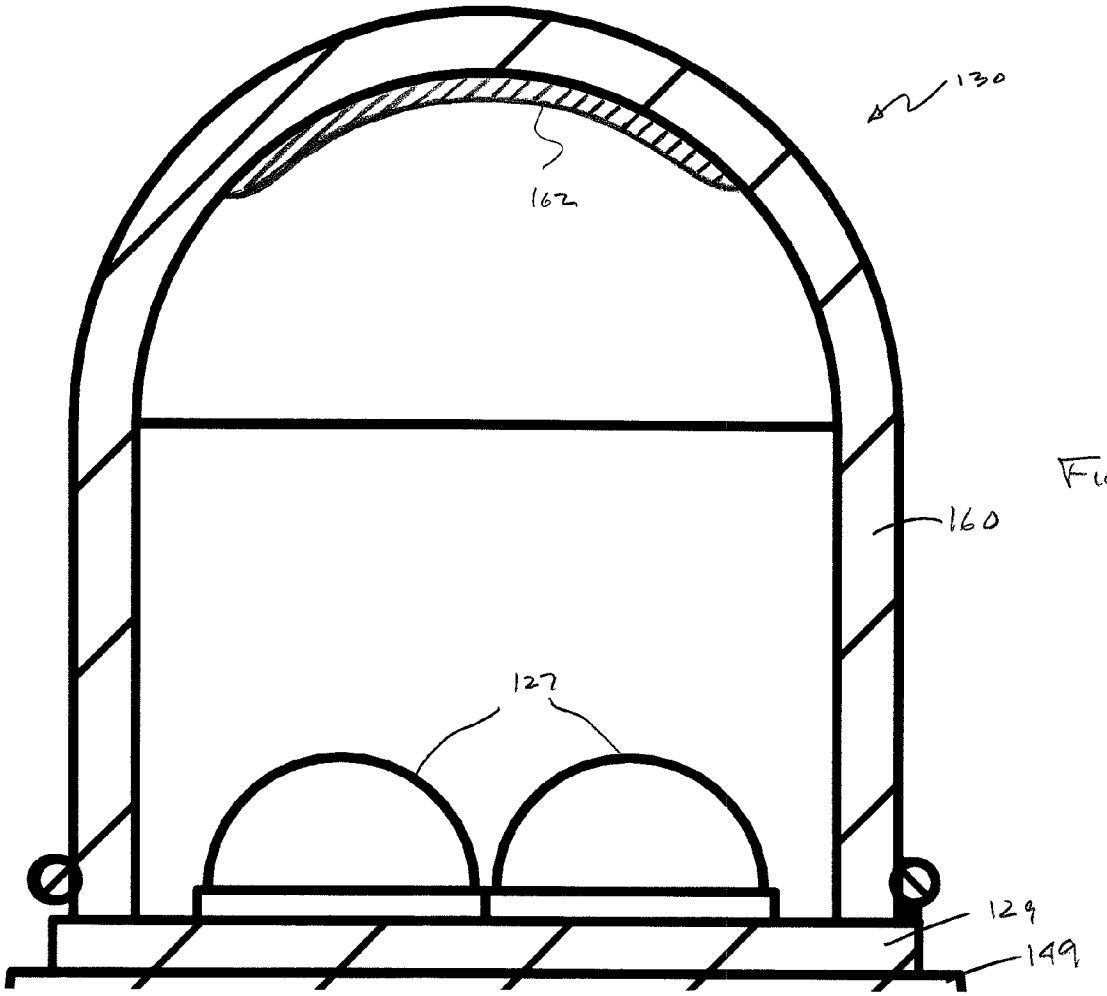

To redirect the light in the desired pattern the pad 162 may be provided at or near the top of the lumophoric dome 160 to reflect some of the light from the top of the dome toward the bottom and sides of the dome. The pad 162 may be made of various sizes and shapes and may be located at various positions on the dome to redirect the light in a desired pattern. Moreover, more than one pad 162 may be used as shown in FIG. 4. The pad 162 may be provided on the outside of the dome 160 as shown in FIGS. 3-5 or on the inside of the dome 160 as shown in FIG. 6.

The pad 162 may be made of any suitable material and may be made reflective, diffuse reflective, partially reflective, partially transmissive, light scattering and/or translucent. The reflectivity of the pad 162 may be selected to reflect and/or transmit a desired portion of the light that contacts the pad to alter the light pattern emitted by the lamp to a desired pattern. In one embodiment the material is a partially reflective material that reflects or diffuses a portion of the light while allowing another portion of the light to be transmitted through the pad. The use of a partially reflective pad prevents the creation of a dark spot that may otherwise be created on the dome if a completely reflective pad is used. However, in some embodiments a reflective material may be used. In one embodiment the pad may be formed by a precursor component that is impregnated with a diffuser or reflective material. The precursor component refers to without limitation to one or more materials or one or more compositions of matter that are capable of transitioning from a liquid to a solid, semi-solid, or gel suitable for use in or with a light emitting device as a coating of, around, or about one or more components of the lighting device. Suitable curable transparent components providing low index of refraction and/or highly visible light transparent organic polymers include silicones, polysiloxanes, polyesters, polyurethanes, acrylics (e.g., polyacrylates, polymethacrylates, hereafter "poly(meth)acrylates"), epoxies, fluoropolymers, and combinations thereof. Curing and/or crosslinking of the polymer matrix can be affected by heat, light, ionizing radiation, moisture, or combinations thereof. Catalysts may be used to facilitate the curing of the polymer matrix. Cure-inhibitors may be used to extend the self-life of the polymer matrix prior to and during use.

In certain aspects, the curable coating and/or one or more precursor components can further comprise one or more of a diffusing material and/or phosphors and/or spectral notch filter compounds (e.g. rare-earth element compounds). Thus, the diffuser may be combined with a phosphor and/or notch filter. Diffusers include light reflecting particles, for example, from material of high index of refraction, such as material with an index of refraction of greater than about 2, greater than about 2.2, and greater than or equal to about 2.4, such as titanium dioxide, aluminum oxide, zinc oxide, zinc sulfide, silicon dioxide and combinations thereof. The average particle size of the diffuser particles can be between about 1 nanometer (nanoparticles) to about 500 microns. The diffuser can be added alone or in combination with the phosphor or spectral notch component to the curable coating. The amount of diffuser used can be adjusted depending on the chemical nature of the diffusing material, its index of refraction, its average particle size, the wavelentgh of light emitted by the LED's, etc., so as to provide the desired optical characteristics. In one embodiment silicone material impregnated with $TiO_2$ may be used to create a partially reflective pad. The thickness of the pad and the amount of $TiO_2$ in the silicone may be selected to make the pad more or less reflective and light transmissive.

Figure 7:
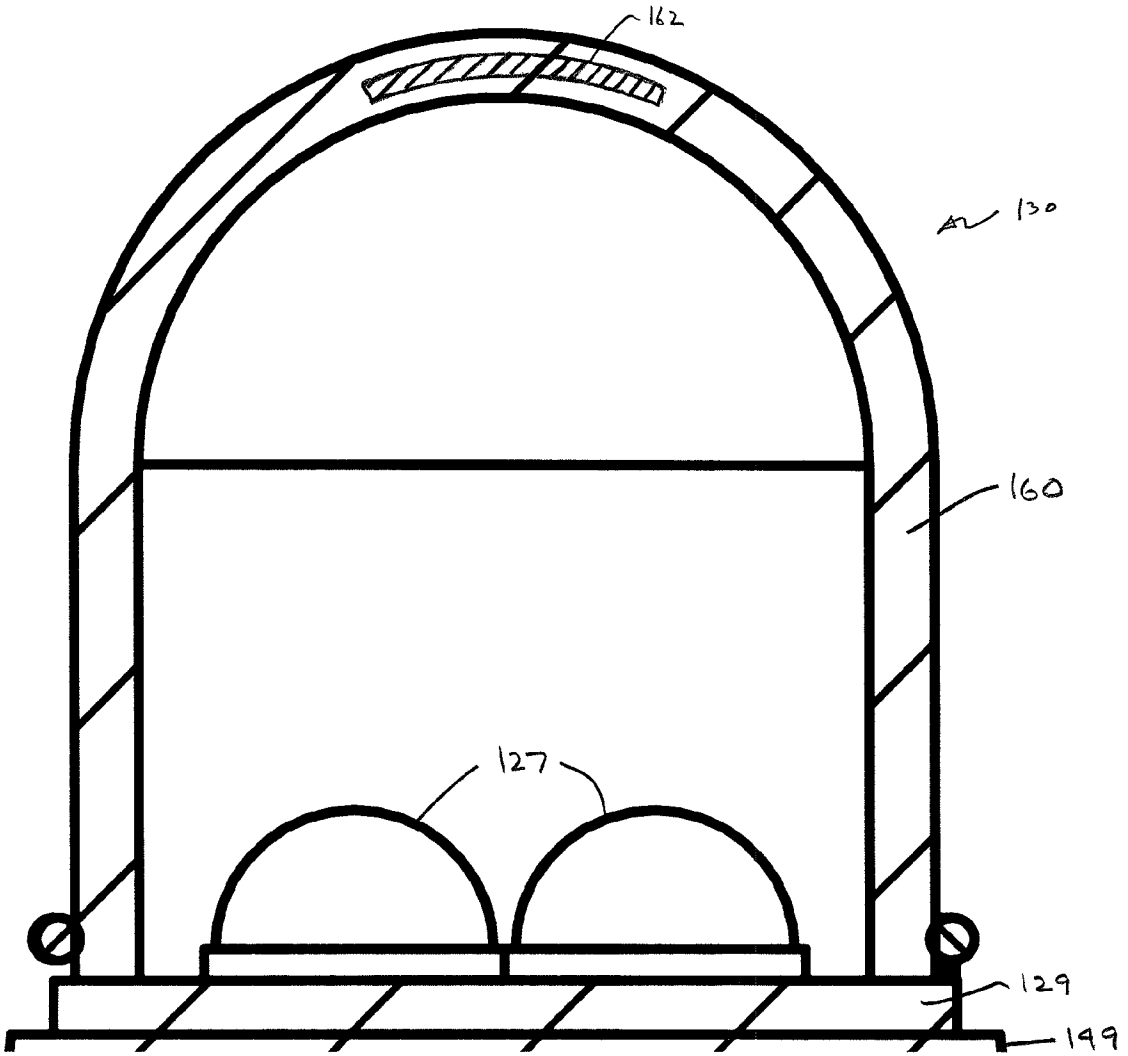

Because the lumophoric dome 160 may be made by an injection molding process, the pad 162 may be added to the lumophoric dome by introducing the precursor/diffuser material, such as silicone/$TiO_2$, in a second infusion in the molding process for the dome to create a molded dome such as shown in FIGS. 3 and 4. In other embodiments, the pad 162 may be added in a second molding operation after the lumophoric dome is made. In some embodiments, the pad 162 may be arranged in the wall of the dome 160 between the inside surface and the outside surface of the dome such as by an insert molding process as shown in FIG. 7.

In other embodiments the pad may be applied as a liquid to the dome and cured to create a coating on the dome as shown in FIGS. 5 and 6. The pad may be added to the inside or outside surface of the dome as either a coating or as a molded member. Any coating or dispensing method useful for materials of similar viscosity to that of the precursor components (mixed or separately, with or without diffuser) can be used. For example, each part of a two-part composition can be separately handled, for example, in a spray apparatus, or they can be combined prior to or subsequent to being sprayed, atomized, or rolled on a surface of the LED lamp. In other example, the LED lamp or component can be dip coated into a bath of one or more of the precursor components. The precursor components can be mixed together or can be configured in separate baths for sequential dipping of the LED lamp. In another aspect, the LED lamp can be cascade-coated by passing through one or more flowing streams of one or more precursor components Ink-jet printing equipment can be used to provide a pattern of any kind, e.g., dots, lines, geometric shapes, etc. and can also be used to control the thickness of such patterns or portions of patterns as desired to modulate the lighting characteristics of the LED lamp or components thereof. In another aspect, a combination of coating processes can be used, for example, a dip or cascade coating in combination with a spray coating. In one aspect, a second spray coating process can provide for one or more "coats" deposited on a first coating that was previously deposited so as to provide a defined thicker coating about the portions of the LED lamp, for example.

In other embodiments the pad may comprise a white plastic diffusing member secured to or imbedded in the lumophoric dome. The pad may also be provided by a diffuser layer created by texturing a member to create a diffuser layer such as by a textured plastic insert.

The use of a lumophoric dome 160 having a partially reflective pad 162 may be used in any LED application to alter the light pattern emitted from the lumophoric dome and is not limited to the specific embodiments of lamps described herein. While specific embodiments of the pad are described, the pad may be made of any suitable material that is at least partially reflective and the pad may be applied to the dome using any suitable mechanism. The location, size, shape, material of the pad may be altered to achieve any suitable light distribution pattern. The placement of the pad at the top end of the lumophoric dome opposite to the LEDs 127 creates more backlight in the embodiment of the lamp described herein. In other embodiments the pad may be located on a side of the dome to create a directional LED assembly that emits light in various patterns.

Using the blue LEDs 127 and the remote lumophoric dome 160 provides a number of advantages in addition to shaping the light distribution pattern afforded by using the partially reflective pad 162. The dome 160 may be changed such that the lamp may produce different light outputs by changing the lumophoric material properties of the dome. For example, different domes may be used with the same lamp construction to change the Correlated Color Temperature (CCT) of the emitted light. For example the dome characteristics may be changed to create light having a CCT of 5000K, 3000K or 2000K for different applications. Other CCTs may also be provided. The ability to change the lumophoric dome to create different light properties provides modularity where the basic lamp construction may provide different light outputs by simply changing a single component. The use of the remote lumophoric dome 160 also produces an omnidirectional light pattern that may not be created with a local phosphor on the LEDs. An omnidirectional light pattern is particularly advantageous in lamps that are intended to be used as replacements for traditional standard incandescent bulbs. The use of a remote lumophoric dome also generates approximately 5-10% less heat at the LEDs when compared to similar LEDs using a local phosphor.

Once the heat sink 149 is attached to the LED assembly 130, this subcomponent may be attached to the base 102 as a unit. The heat sink 149 may be attached to the base using a mechanical snap-fit mechanism such as flexible engagement members 109 (FIG. 8) on the base 102 that engage second mating engagement members on the heat sink structure 149. The snap-fit connection allows the base 102 to be fixed to the heat sink 149 in a simple insertion operation without the need for any additional connection mechanisms, tools or assembly steps. The base may be fixed to the heat sink using other connection mechanisms such as adhesive, welding, a bayonet connection, screwthreads, friction fit or the like.

The enclosure 112 may be attached to the heat sink 149. In one embodiment, the LED assembly 130 and the heat conducting portion 152 are inserted into the enclosure 112 through the neck 115. The neck 115 and heat sink dissipation portion 154 are dimensioned and configured such that the rim of the enclosure 112 sits on the upper surface of the heat dissipation portion 154 with the heat dissipation portion 154 disposed at least partially outside of the enclosure 112, between the enclosure 112 and the base 102. To secure these components together a bead of adhesive may be applied to the upper surface 154*a* of the heat dissipation portion 154. The rim of the enclosure 112 may be brought into contact with the bead of adhesive to secure the enclosure 112 to the heat sink 149 and complete the lamp assembly.

In some embodiments the form factor of the lamp is configured to fit within the existing standard for a lamp such as the A21 ANSI standard. Moreover, in some embodiments the size, shape and form of the LED lamp may be similar to the size, shape and form of other traditional incandescent bulbs. Users have become accustomed to incandescent bulbs having particular shapes and sizes such that lamps that do not conform to traditional forms may not be as commercially acceptable. The LED lamp of the invention is designed to provide desired performance characteristics while having the size, shape and form of a traditional incandescent bulb.

FIGS. 9-13 show an embodiment of a lamp that uses the LED assembly 130, heat sink with the tower arrangement 149, and lumophoric dome 160 as previously described in a BR and PAR type lamp. The previous embodiments of a lamp refer more specifically to an omnidirectional lamp such as an A21 replacement bulb. In the BR or PAR lamp shown in FIGS. 9-13 the light is emitted in a directional pattern rather than in an omnidirectional pattern. Standard PAR bulbs are reflector bulbs that reflect light in a direction where the beam angle is tightly controlled using a parabolic reflector. PAR lamps may direct the light in a pattern having a tightly controlled beam angle such as, but not limited to, 10°, 25° and 40°. Standard BR type bulbs are reflector bulbs that reflect light in a directional pattern; however, the beam angle is not tightly controlled and may be up to about 90-100 degrees or other fairly wide angles. The bulb shown in FIGS. 9-14 may be used as a solid state replacement for such BR, PAR or reflector type bulbs or other similar bulbs.

The lamp comprises a base 102, heat sink 149, LED assembly 130 and lumophoric dome 160 as previously described. As previously explained, the LED assembly 130 generates an omnidirectional light pattern. To create a directional light pattern, a reflector 300 may be provided inside of the lamp housing 302 that reflects light generated by the LED assembly 130 generally in a direction along the axis of the lamp. The reflector 300 may reflect the light in a narrow beam angle. The reflector 300 may comprise a variety of shapes and sizes provided that light reflecting off of the reflective surface 304 of reflector 300 is reflected generally along the axis of the lamp in a relatively narrow beam angle. The reflective surface 304 may, for example, be conical, parabolic, hemispherical, faceted or the like. In some embodiments, the reflective surface may be a diffuse or Lambertian reflector and may be made of a white highly reflective material such as injection molded plastic, white optics, PET, MCPET, or other reflective materials. The reflective surface may reflect light but also allow some light to pass through it. The reflective surface may be made of a specular material. The specular reflectors may be injection molded plastic or die cast metal (aluminum, zinc, magnesium) with a specular coating. Such coatings could be applied via vacuum metallization or sputtering, and could be aluminum or silver. The specular material could also be a formed film, such as 3M's Vikuiti ESR (Enhanced Specular Reflector) film. It could also be formed aluminum, or a flower petal arrangement in aluminum using Alanod's Miro or Miro Silver sheet. The reflective surface 304 may also comprise a polished metal surface. Some of the light generated by the LED assembly 130 may also be projected directly out of the exit surface 308 without being reflected by the reflector 300.

The reflector 300 is mounted in the lamp such that the reflective surface 304 surrounds the LED assembly 130 and reflects some of the light generated by the LED assembly. Because the reflective surface 304 may be at least 95% reflective, the more light that hits the reflector 300 the more efficient the lamp. The reflector 300 may be mounted on the heat sink 149, the housing 302 and/or LED assembly 130 using a variety of connection mechanisms. In one embodiment, the reflector 300 is mounted on the heat conducting portion or tower 152 of the heat sink 149. The reflector 300 may be mounted to the heat sink 149 or LED assembly 130 using separate fasteners, adhesive, friction fit, mechanical engagement such as a snap-fit connection, welding or the like. In one embodiment, the reflector 300 is made in two portions that together surround the heat conducting portion or tower 152 and connect to one another using snap fit connectors to clamp the heat sink therebetween.

The LED assembly 130, heat sink 149 and lumophoric dome 160 may be inserted through the opening 308 in the neck of the housing 302. The housing 302 may be secured to the heat sink 149 using adhesive, mechanical connectors or other connection mechanism.

Figure 14:
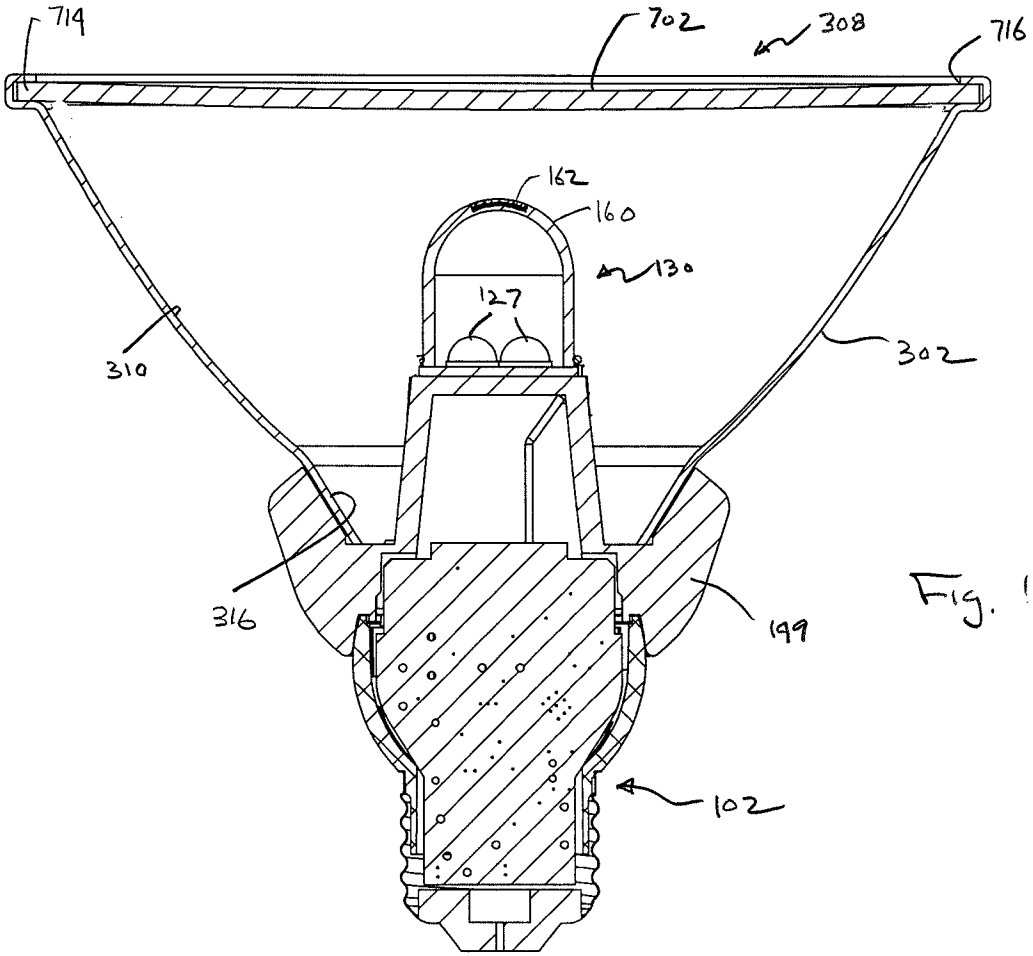
FIG. 14 is a section view similar to FIG. 12 of another embodiment of the lamp of the invention.

FIG. 14 shows an alternate embodiment of a PAR or BR type lamp that uses the LED assembly 130, heat sink with the tower arrangement 149 and lumophoric dome 160 as previously described. To emit the light in a directional pattern the interior surface 310 of the housing 302 may be used as the reflective surface rather than using the reflector 300 as previously described. To create a directional light pattern, the interior surface of the housing is shaped to reflect the light emitted from the phosphor dome generally in a direction along the axis of the lamp. The reflective surface 310 may reflect the light in a tightly controlled beam angle. The reflective surface 310 may comprise a parabolic shape such that light reflecting off of the reflector 310 is reflected generally along the axis of the lamp to create a beam with a controlled beam angle. The reflective surface 310 may be made of a specular material. The housing may be injection molded plastic or die cast metal (aluminum, zinc, magnesium) with a specular coating. Such coatings could be applied via vacuum metallization or sputtering, and could be aluminum or silver. The specular material could also be a formed film, such as 3M's Vikuiti ESR (Enhanced Specular Reflector) film. It could also be formed aluminum, or a flower petal arrangement in aluminum using Alanod's Miro or Miro Silver sheet. The reflective surface 304 may also comprise a polished metal surface. Some of the light generated by the LED assembly 130 may also be projected directly out of the exit surface 308 without being reflected by the reflective surface 310.

Figure 15:
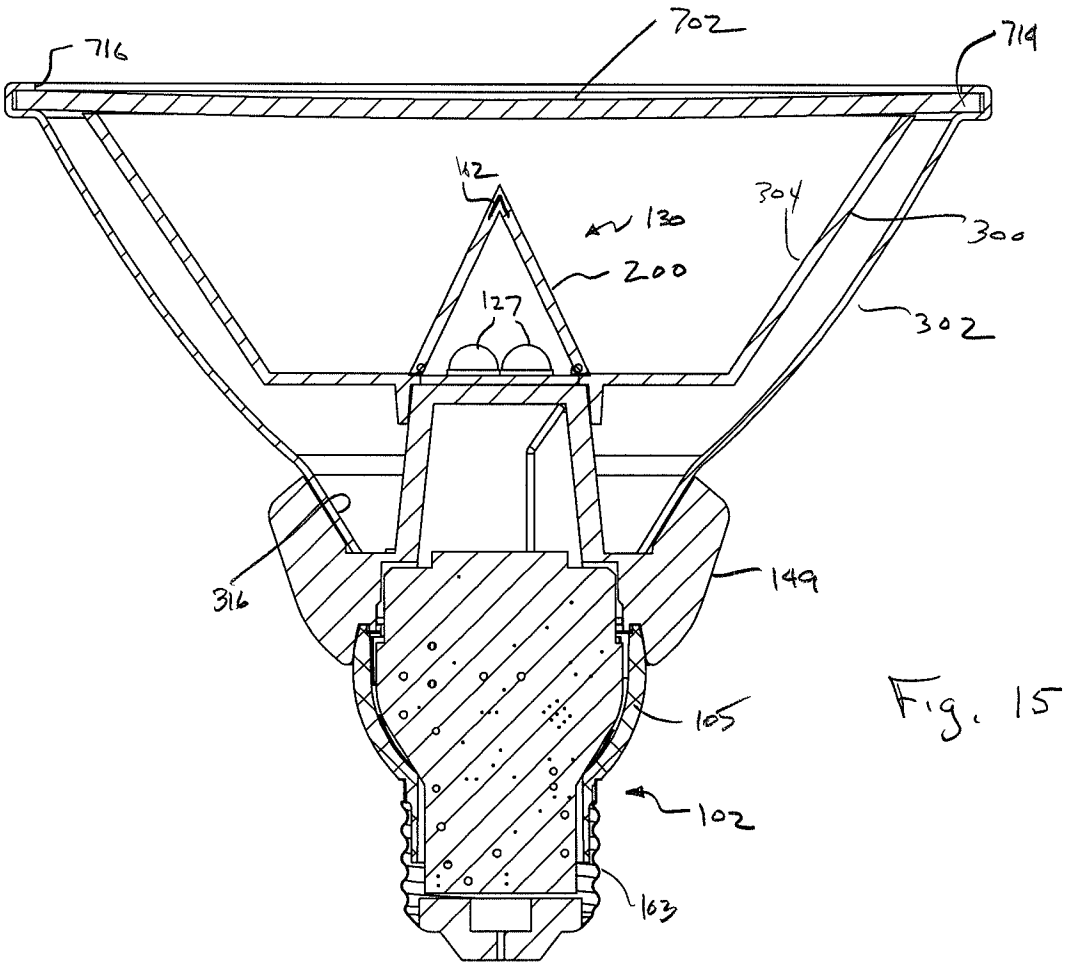
FIG. 15 is a section view similar to FIG. 12 of yet another embodiment of the lamp of the invention.
Figure 16:
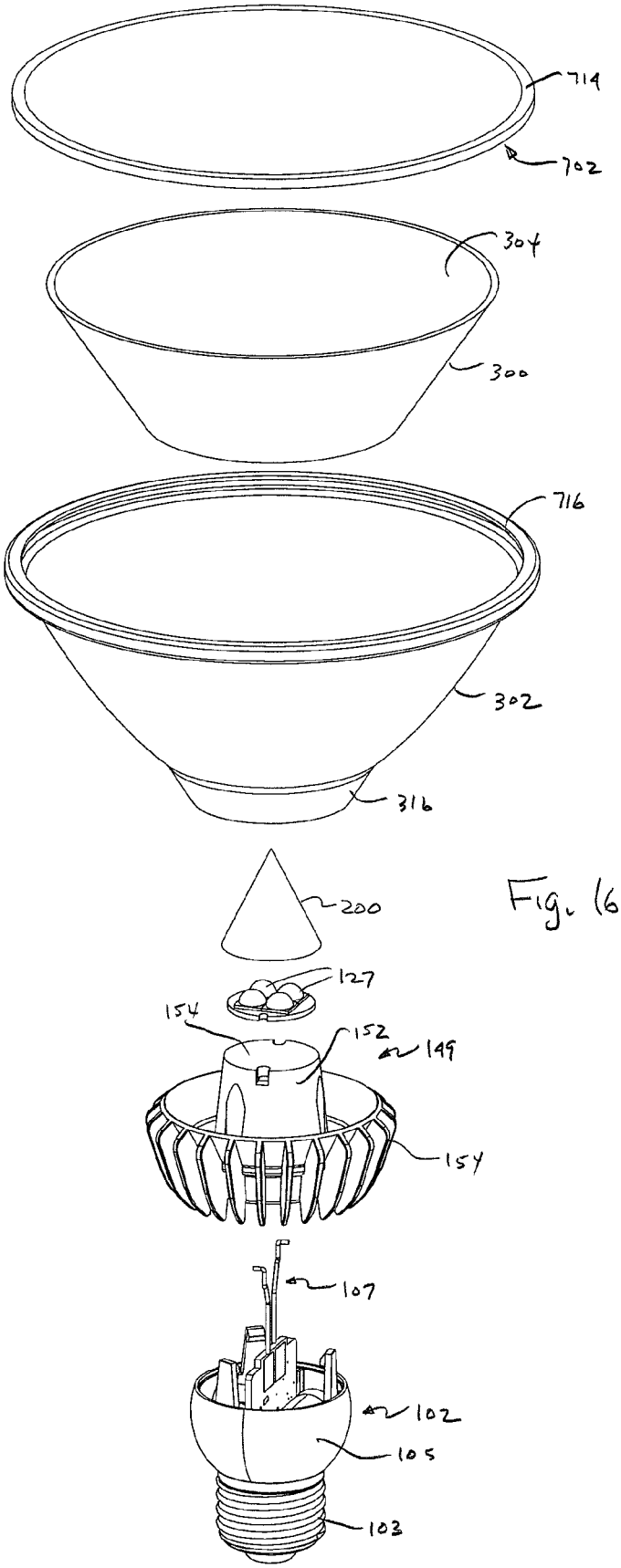
FIG. 16 is an exploded perspective view of the lamp of FIG. 15.
Figure 17:
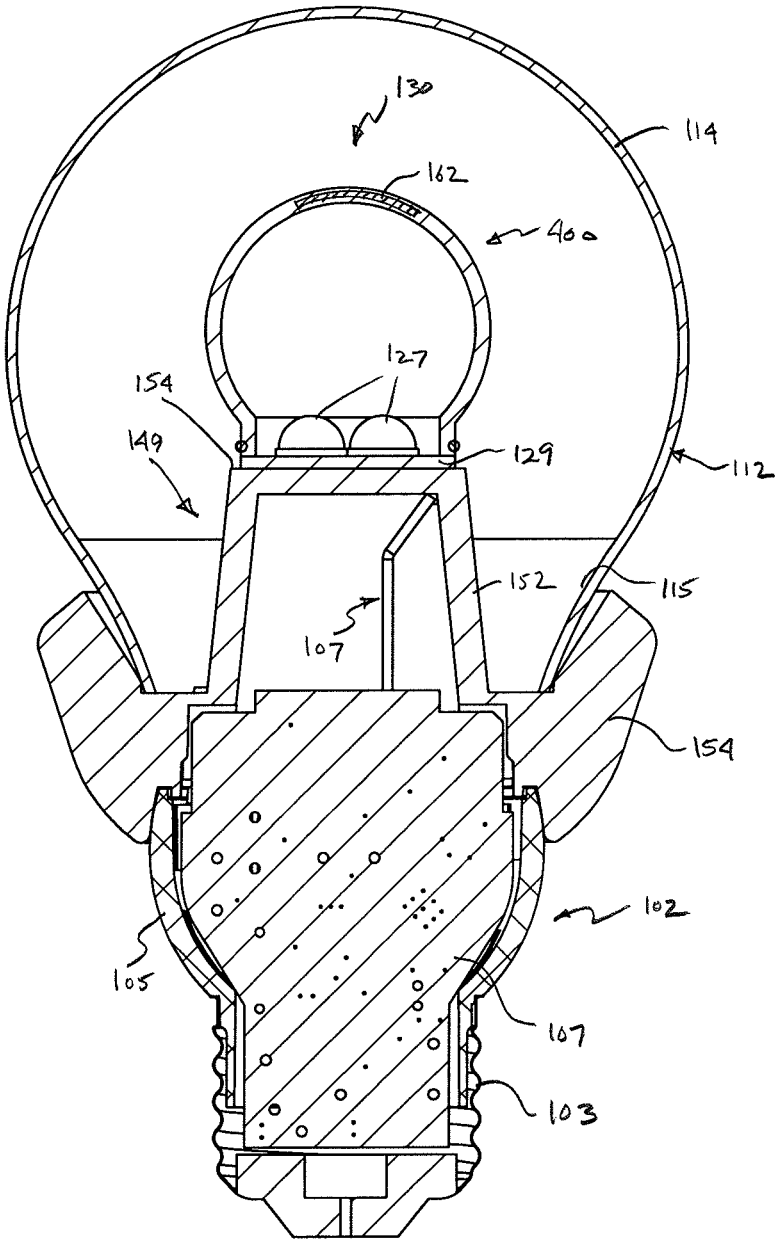
FIG. 17 is a section view similar to FIG. 2 of yet another embodiment of the lamp of the invention.
Figure 18:
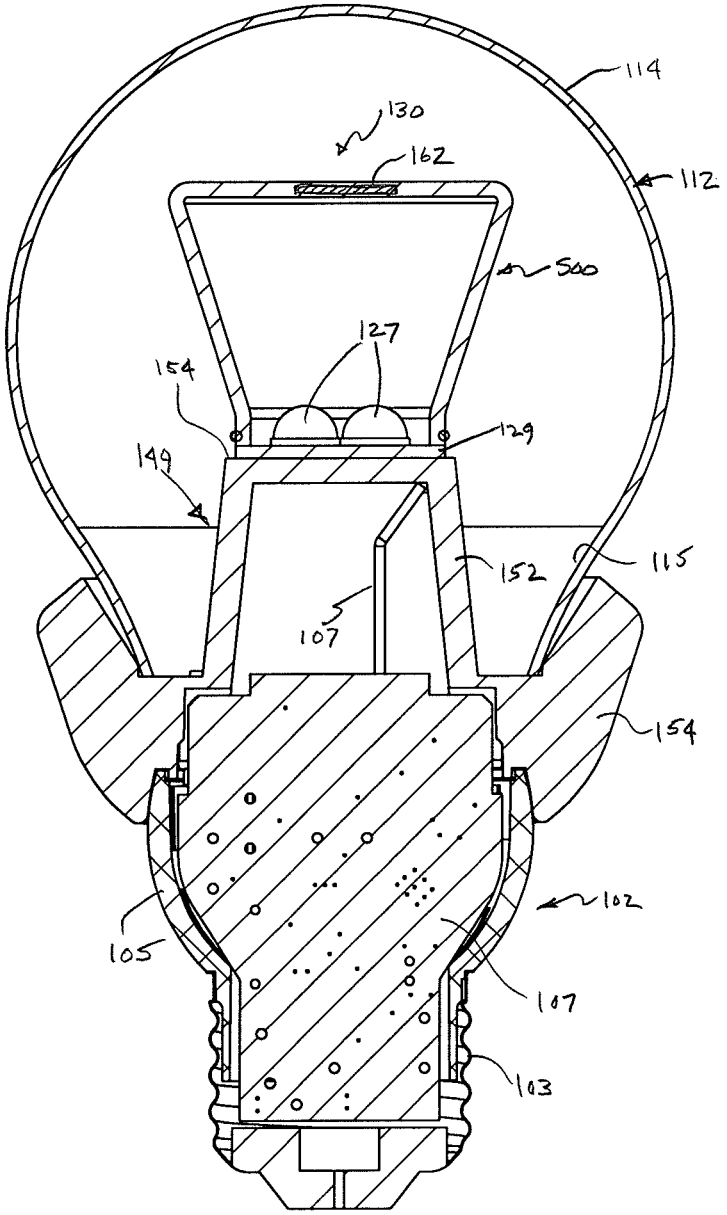
FIG. 18 is a section view similar to FIG. 2 of yet another embodiment of the lamp of the invention.

FIGS. 15 and 16 show another embodiment of the lamp of the invention where the lumophoric dome 200 is shaped as a cone rather than as an elongated dome as shown in the previous embodiments. The conical lumophoric dome 200 emits more light laterally than towards the top of the lamp than the elongated dome-shape lumophoric dome 160 such that relatively more light is emitted toward the reflective surface 304 than directly toward lens 702. The use of a conical lumophoric dome 200 is particularly useful in a directional lamp such as a replacement for a PAR or BR lamp where it may be desirable to reflect more light laterally off of the surrounding reflective surface 304 than directly out of lens 702. A pad 162 may be used in the conical lumophoric dome 200 to further shape the pattern of light emitted from the dome. FIG. 17 shows another embodiment of the lamp of the invention where the lumophoric dome 400 is shaped as a sphere rather than as an elongated dome as shown in the previous embodiments. The spherical lumophoric dome 400 emits light generally omnidirectionally. A pad 162 may be used with the dome 400 as previously described to manipulate the light pattern emitted by the LED assembly to a desired light pattern. The use of a spherical lumophoric dome 400 may be particularly useful in an omnidirectional lamp such as a replacement for an A19 bulb or other omnidirectional bulb. FIG. 18 shows another embodiment of the lamp of the invention where the lumophoric dome 500 is shaped as an inverted truncated conical dome where the base of the dome is directed toward the top of the enclosure 112. The cone is truncated such that the bottom of the dome 500 does not extend to a point in order to allow sufficient space for the positioning of the LEDs 127. The inverted conical lumophoric dome 500 emits light generally omnidirectionally. A pad 162 may be used with the dome 500 as previously described to manipulate the light pattern emitted by the LED assembly to a desired light pattern. The use of an inverted conical dome may be particularly useful in an omnidirectional lamp such as a replacement for an A19 bulb or other omnidirectional bulb. While various example embodiments of dome shapes are disclosed herein different dome shapes may be used depending on the desired light pattern output by the LED assembly. Further. It is to be understood that the domes shown in directional lamps may be used in omnidirectional lamps and domes used in omnidirectional lamps may be used in directional lamps.

The light that is reflected from the reflective surface and light emitted directly from LED assembly 130 is directed towards lens 702. To further define a narrow beam angle the lens 702 may be made concave such that the exterior surface 702*a* of the lens is slightly concave and the interior surface of the lens is slightly convex. The curved lens emits the light in a slightly narrower beam angle than a flat or convex lens. While the lens 702 is shown as slightly curved the lens may be flat or convex if beam shaping by the lens is not required. A lens according to example embodiments of the invention can be made from various materials, including acrylic, polycarbonate, glass, polyarylate, and many other transparent materials. While the lens may have a surface shape it is a generally planar member dimensioned to fit into the opening in the lamp housing.

Figure 9:
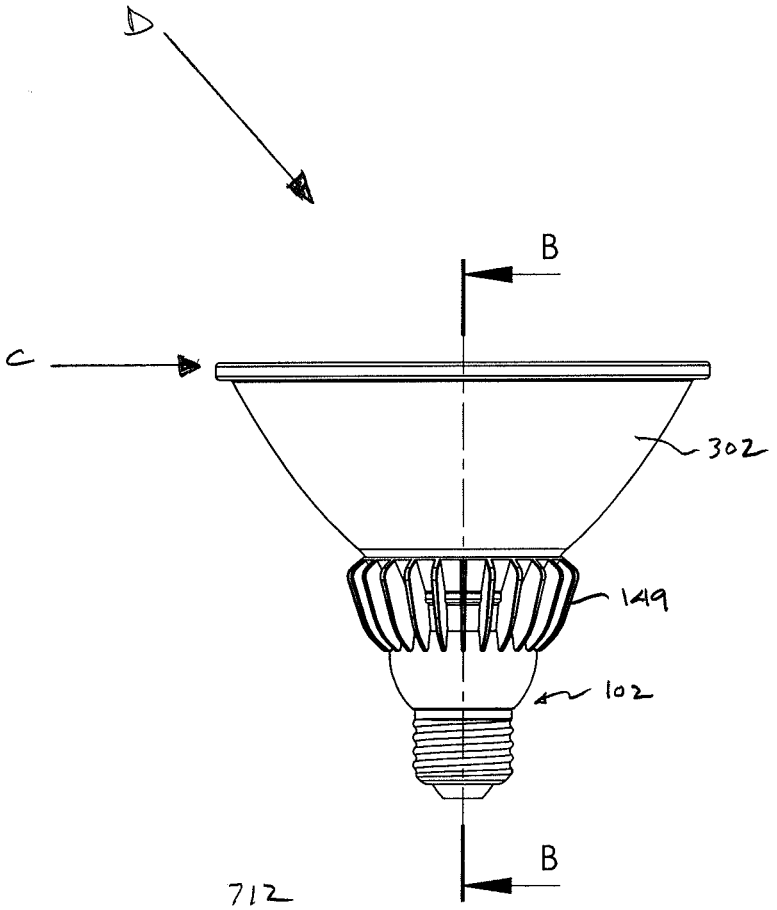
FIG. 9 is a front view of another embodiment of a lamp of the invention.
Figure 10:
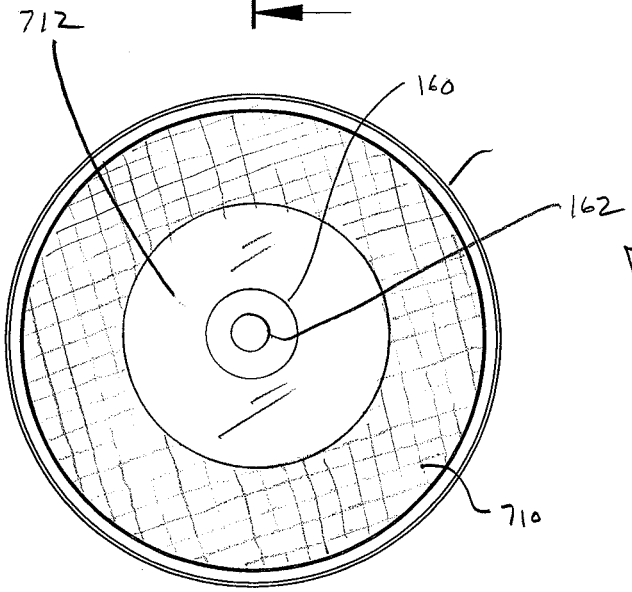
FIG. 10 is a top view of the lamp of FIG. 9.
Figure 11:
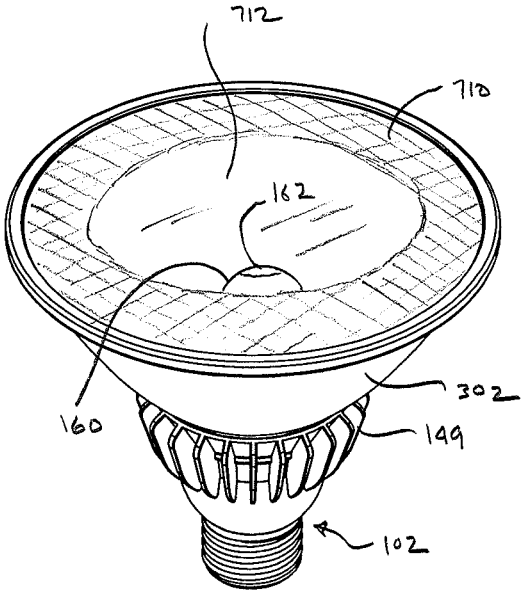
FIG. 11 is a perspective view of the lamp of FIG. 9.
Figure 12:
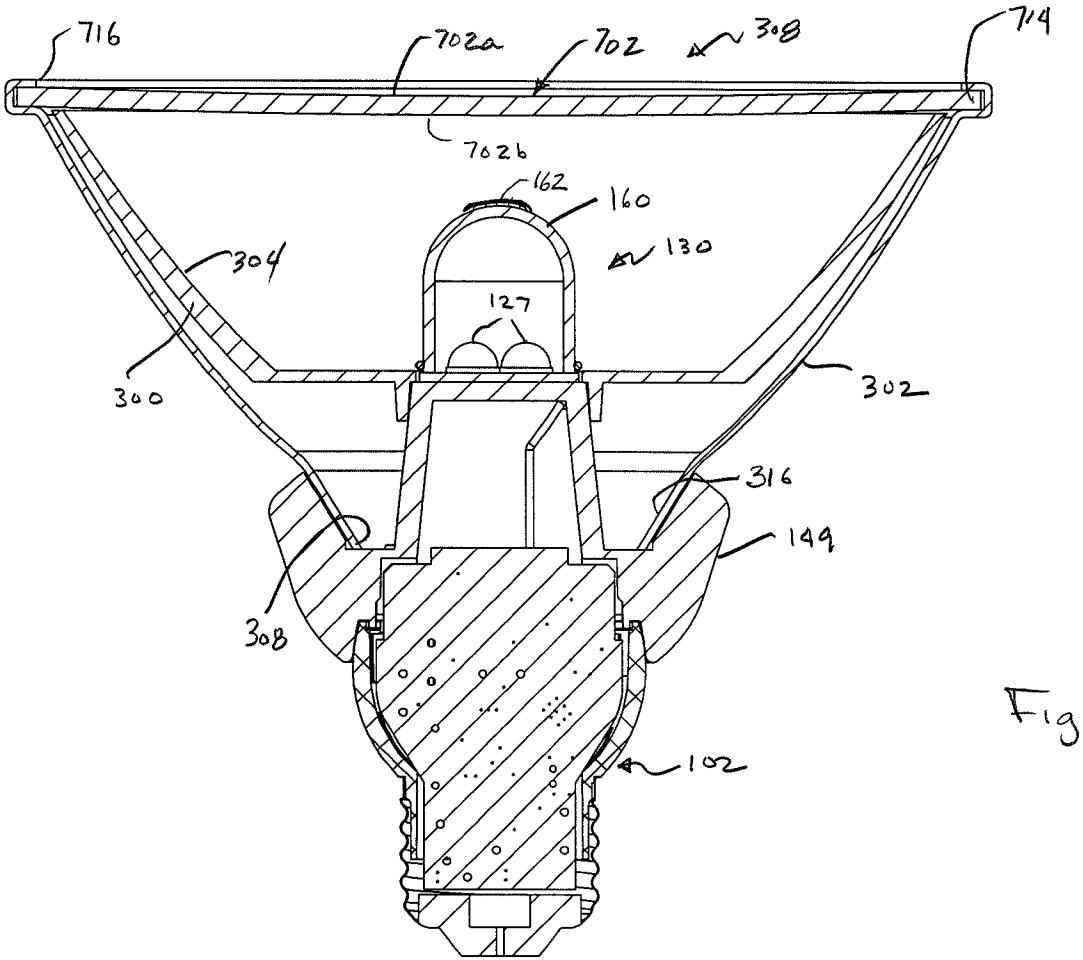
FIG. 12 is a section view taken along line B-B of FIG. 9.
Figure 13:
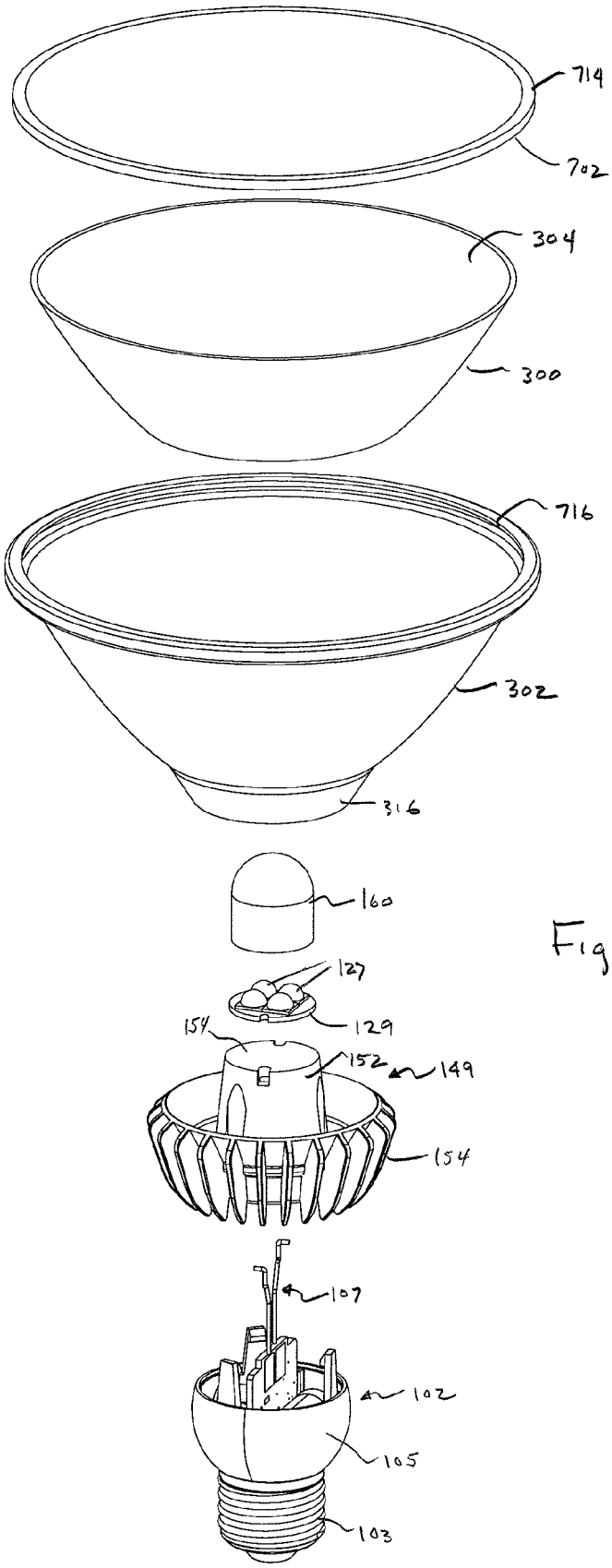
FIG. 13 is an exploded perspective view of the lamp of FIG. 9.

Lens 702 may include a surface textured area 710 in an annular band around the periphery of the lens. The interior area 712 of the lens may be transparent. The surface texturing may be used to provide diffusion for light exiting the lamp. The surface texture is represented in FIG. 9 schematically; however, could consist of dimpling, frosting, etching, coating or any other type of texture that can be applied to a lens to diffuse the light exiting the lamp. The textured surface of the lens can be created in many ways. For example, a smooth surface could be roughened. The surface could be molded with textured features. Such a surface may be, for example, prismatic in nature. A lens according to embodiments of the invention can also consist of multiple parts co-molded or co-extruded together. For example, the textured surface could be another material co-molded or co-extruded with the portion of the lens.

The textured area 710 is arranged in a peripheral band such that light transmitted through the textured area will be diffused and spread to increase the beam angle of the light emitted from the lamp. In one embodiment the textured area is arranged adjacent the peripheral edge of the lens with a transparent area 712 inside of the annular textured area 710. Light exiting through the transparent center area 712 is not diffused. The reflective surface is designed to deliver a relatively tight beam angle to the lens 702. The textured area 710 is then used to spread the tight beam angle to a desired wider beam angle. The amount and type of texturing may be controlled to control the spread of the beam angle to a desired beam angle. For example, the width of the textured area may be increased or decreased to increase or decrease the spread of the light pattern. Thus, the reflective surface and curvature of the lens are used to create a narrow beam angle and the surface texturing is used to spread the narrow beam angle to a desired width. The arrangement also provides a high peak center beam candle power because the light is focused in a relatively tight pattern by the reflective surface while allowing the textured area to spread the beam angle to a desired beam angle.

The texturing of the lens in a peripheral annular band also provides a performance advantage in the visual appearance of the lamp. It will be appreciated that as the viewing angle of a person observing the lamp moves from a shallow angle represented by arrow C that is approximately in-line with the surface of the lens to a steeper angle represented by arrow D disposed above the lens, the internal structure of the lamp such as the dome 160 gradually becomes visible to the viewer. The textured area 710 provides a transition area between the relatively dark view at the horizon, arrow C, to the very bright view at a point over the lamp such that the observed light does not quickly transition from dark to light. The texturing 710 also hides the internal components at shallow viewing angles. The internal components generally are not visible at steep viewing angles because the brightness of the center beam obscures the internal components.

The lens 702 may comprise a peripheral rim 714 at the edge thereof that is retained in a channel 716 formed at the distal end of the housing 302. In some embodiments, the lens 702 may be positioned in the open end of the housing 302 and a curling die may be used to curl the end of the housing over the rim 716 of the lens to form channel 716 and retain the lens in the housing. The lens 702 may be secured to the housing using other mechanisms such as adhesive, a separate mechanical connector or the like.

The pad 162 may be used on the textured area dome 160 as previously described to control the pattern of light emitted from the dome in embodiments of the directional lamps. In the directional lamp, the pad 162 may be positioned and used to direct more light toward the reflective surface 304, 310. In such an embodiment the pad may be positioned at the distal end of the dome remote from the LEDs 127. Because the pad 162 may be made at least partially optically transmissive the pad does not form a dark spot on the dome 160 during use of the lamp.

As is evident from the foregoing description, a lamp constructed using the reflective surface 304, 310 and the lens 702 may produce light with a beam angle that varies from a wide angle flood pattern to a tightly controlled spot pattern. As a result, the construction allows the lamp to replace either a wide angle lamp such as a BR lamp or a narrow beam angle lamp such as a PAR lamp.

The housing 302 may be formed of a thermally conductive material such as metal and may be formed, for example, of aluminum. Other thermally conductive materials, in addition to metals, such as ceramic may also be used. The housing 302 is mounted to the heat sink 149 such that the housing 302 is thermally coupled to the heat sink 149. By thermally coupling the heat sink 149 to the housing 302, the housing 302 forms part of the heat sink for the lamp and increases the exposed surface area of the heat sink to facilitate heat transfer from the LED assembly 130 to the ambient environment. The thermal coupling of the heat sink 149 to the housing 302 may be made by providing a direct surface to surface contact between the heat sink 149 and the housing 302. In one embodiment, the housing 302 is formed with a flange 316 at a proximal end thereof. The flange 316 has an annular shape such that the tower portion of the heat sink 149 and the LED assembly 130 may be inserted through the aperture 308 into the interior of the housing 302. The flange 316 is seated on the heat sink 149 such that the surface of the flange 316 and the heat sink are in good surface to surface contact such that heat may be transferred from the heat sink 149 to the housing 302. While in the illustrated embodiment, the flange 316 of the housing 302 and the heat sink 149 are in direct surface to surface contact with one another, intervening elements may be present provided efficient thermal transfer occurs between the heat sink 149 and the housing 302. For example, thermal adhesive, a metal layer or the like may be disposed between the heat sink 149 and the housing 302.

The use of the housing 302 as the heat sink may be particularly useful in higher power lamps, such as 90 watt PAR lamps and higher power lamps, where more heat is generated that may be dissipated to the ambient environment over the relatively large surface area of the heat sink and reflector. While the arrangement is particularly beneficial with higher power lamps the arrangement may be used in any size lamp.

Although specific embodiments have been shown and described herein, those of ordinary skill in the art appreciate that any arrangement, which is calculated to achieve the same purpose, may be substituted for the specific embodiments shown and that the invention has other applications in other environments. This application is intended to cover any adaptations or variations of the present invention. The following claims are in no way intended to limit the scope of the invention to the specific embodiments described herein.

The invention claimed is:

1. A lamp comprising:

an enclosure being at least partially optically transmissive;

a base;

at least one LED located in the enclosure and operable to emit light when energized through an electrical path from the base;

a lumophoric dome remote from the at least one LED and surrounding the at least one LED where the lumophoric dome comprises an inside surface and an outside surface, the at least one LED disposed horizontally and positioned adjacent the bottom of the lumophoric dome;

a heat sink comprising a heat dissipating portion that is at least partially exposed to the ambient environment and a heat conducting portion that is thermally coupled to the at least one LED;

an at least partially reflective and partially transmissive pad positioned in the the lumophoric dome between the inside surface and the outside surface, the pad disposed over at least the top of the lumophoric dome opposite the at least one LED and extending for less than the entire dome for manipulating the pattern of light emitted from the lumophoric dome such that some of the light is redirected toward the sides of the lamp.

2. The lamp of claim 1 wherein the base comprises an Edison connector.

3. The lamp of claim 1 wherein the at least one LED is mounted on the heat sink in a center of the enclosure.

4. The lamp of claim 3 wherein the at least one LED is attached to a submount and the submount is thermally and mechanically coupled to the heat sink.

5. The lamp of claim 1 wherein the at least one LED emits blue light and the lumiphoric dome emits a white light.

6. The lamp of claim 1 wherein the at least one LED provides a Lumen output of between 1400 and 1600 Lumens.

7. The lamp of claim 1 wherein the lamp operates at approximately 15 Watts, with approximately 108-110 Lumens per Watt.

8. The lamp of claim 1 wherein the pad comprises a silicone impregnated with TiO2.

9. The lamp of claim 1 further comprising a reflective surface for creating a directional light pattern.

10. The lamp of claim 9 wherein the reflective surface is formed on a lamp housing.

11. The lamp of claim 9 wherein the reflective surface is formed on a reflector located in a lamp housing.

12. The lamp of claim 1 wherein the lumophoric dome is one of a conical shape, a dome-shape, a spherical shape, and a truncated dome shape.

13. The lamp of claim 1 wherein the lumiphoric dome carries a phosphor.

14. The lamp of claim 13 wherein the phosphor is impregnated in the lumiphoric dome.

15. The lamp of claim 13 wherein the phosphor is coated on the lumiphoric dome.

16. The lamp of claim 1 wherein a lamp housing is thermally coupled to the heat sink and is exposed to the exterior of the lamp such that heat from the heat sink may be dissipated to the ambient environment at least partially through the housing.

17. An LED assembly comprising:

at least one LED operable to emit light when energized;

a lumophoric dome comprising an inside surface and an outside surface surrounding the at least one LED;

an at least partially reflective and partially transmissive pad positioned in the lumophoric dome between the inside surface and the outside surface wherein the pad comprises a precursor component and a diffusing material and the pad is molded to the lumophoric dome and extends for less than the entire dome for manipulating the pattern of light emitted from the lumophoric dome such that some of the light is redirected toward the sides of the lamp.

18. The LED assembly of claim 17 wherein the pad is on the outside of the dome.

19. The LED assembly of claim 17 wherein the pad is on the inside of the dome.

20. The LED assembly of claim 17 wherein the pad is partially transmissive.

21. The LED assembly of claim 17 wherein the pad is diffusive.

22. The LED assembly of claim 17 wherein the precursor component comprises silicone.

23. The LED assembly of claim 17 wherein the diffusing material comprises titanium dioxide.

24. A directional lamp comprising:

an enclosure comprising a reflector and an optically transmissive lens for receiving light reflected off of the reflector;

a base connected to the enclosure;

at least one LED located in the enclosure and operable to emit light when energized through an electrical path from the base;

wherein the optically transmissive lens emits light from the enclosure, the lens comprising a first annular area defining a second area interior of the first annular area, the first annular area defined by a textured surface and the second area being transparent and non-diffusive over the entirety of the second area;

a lumophoric dome comprising an inside surface and an outside surface surrounding the at least one LED; and an at least partially reflective and partially transmissive pad positioned in the lumophoric dome between the inside surface and the outside surface wherein the pad extends for less than the entire dome.

25. The directional lamp of claim 24 wherein the annular area is adjacent a peripheral edge of the lens.

26. The directional lamp of claim 24 comprising a lumophoric dome remote from the at least one LED and surrounding the at least one LED, the lumophoric dome configured as an inverted truncated cone, and a partially reflective pad on the lumophoric dome.

* * * * *